US006224194B1

(12) United States Patent
Kohno et al.

(10) Patent No.: US 6,224,194 B1
(45) Date of Patent: May 1, 2001

(54) RECORDING APPARATUS, AND MANUFACTURING METHOD THEREOF

(75) Inventors: Minoru Kohno, Tokyo; Norihiro Onuma, Kanagawa, both of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/285,234

(22) Filed: Apr. 1, 1999

(30) Foreign Application Priority Data

Apr. 3, 1998 (JP) ..... 10-091882

(51) Int. Cl.[7] ..... B41J 2/05
(52) U.S. Cl. ..... 347/56; 347/61; 347/62
(58) Field of Search ..... 347/54, 56, 61, 347/62, 51, 40, 42, 171

(56) References Cited

U.S. PATENT DOCUMENTS 5,592,208 * 1/1997 Shinozaki et al. ..... 347/171
5,828,391 * 10/1998 Shinozaki et al. ..... 347/51

* cited by examiner

*Primary Examiner*—Huan Tran
(74) *Attorney, Agent, or Firm*—Sonnenschein, Nath & Rosenthal

(57) ABSTRACT

In a dye-vaporization thermal transfer method, a heater is configured of a high-resistance portion that is in contact with a low-resistance portion, image information is conducted to the high-resistance portion by electrodes connected to the low-resistance portion, thereby causing the high-resistance portion to generate heat. Consequently, irregularities in the resistance values of the heaters provided to the transfer portions are suppressed, thereby yielding images with high quality.

24 Claims, 17 Drawing Sheets

RECORDING APPARATUS, AND MANUFACTURING METHOD THEREOF

BACKGROUND OF THE INVENTION

1. Field of the Invention

The present invention relates to a recording apparatus (particularly a printer head) configured of a transfer portion for holding recording material and a resistance heating means for heating the recording material such that the recording material is caused to fly, thereby transferring onto a recording medium disposed opposing the transfer portion, and also relates to a method for manufacturing the recording apparatus.

2. Description of the Related Art

In recent years, a field has emerged wherein color images processed with personal computers or the like, or color images taken with video cameras or electronic still photography cameras are printed out, and used for viewing enjoyment or other purposes. Accordingly, there are increasing needs for printers which provide high-quality full-color images, and particularly for personal-use printers or relatively inexpensive printers geared for small-scale businesses (so-called "small-office" "home-office" businesses) which provide such high-quality full-color images.

Color printing methods which have been proposed include the sublimation-type thermal transfer method (or dye dispersion thermal transfer method), the melt thermal transfer method, the ink-jet method, the electro-photography method, the thermal-developing silver-salt method, and so forth. Of these, the dye dispersion thermal transfer method and ink-jet method can be listed as examples of methods whereby high-quality images can be easily output from relatively simple devices.

The dye dispersion thermal transfer method uses an ink ribbon or sheet coated with an ink layer formed by dispersing a high concentration of transfer dye within an appropriate binder resin, and so-called thermal transfer sheets which are formed by coating paper with dyeing resin which accepts the transferred dye. The ink ribbon or sheet is pressed against the thermal transfer sheet at a certain pressure, and a thermo-sensitive recording head (thermal head) applies heat from behind the ink ribbon or sheet, thus performing thermal transfer of transfer dye from the ink ribbon or sheet to the thermal transfer sheet, the amount of transfer dye being transferred according to the amount of heat.

A full-color image with continuous gradation can be obtained by repeating this operation for image signals resolved into the three primary colors of subtractive color mixture, i.e., yellow (Y), magenta (M), and cyan (C).

FIG. 26 shows the configuration of the area surrounding a thermal head of a printer using this dye dispersion thermal transfer method.

A thermal head 70 is positioned so as to oppose a platen roller 77, and an ink sheet 72 which has been formed by providing an ink layer 73 on a base film 71, for example, along with a recording sheet (thermal transfer paper) 75 formed by coating the surface of paper 76 with a dying resin layer (dye-accepting layer) 74, run in the direction of the arrow B in the Figure while being pressed against the thermal head 70 by the platen roller 77 which rotates in the direction of the arrow A in the Figure.

Then, the ink in the ink layer 73 selectively heated by the thermal head 70 according to the image to be printed is subjected to thermal dispersion into the dying resin layer 74 of the recording sheet 75 which has been heated by coming into contact with the ink layer 73, and transfer is carried out by dot pattern, for example.

This dye dispersion thermal transfer method is an excellent technique in that the printer can be reduced in size and maintenance thereof is simple, the printer has immediate availability, and images with quality rivaling that of silver-salt color photography can be obtained. However, this method is problematic in that disposal of the ink ribbon or sheet results in massive amounts of discarded materials and high running costs. This method also necessitates the use of thermal transfer sheets, which also raises running costs.

The melt thermal transfer method can be used with plain paper, but still uses ink ribbon or sheet, and so this method is also problematic in that the disposal of such results in massive amounts of discarded materials and high running costs. Further, the image quality is lower than that of silver-salt color photography.

The thermal developing silver-salt method is high in image quality, but necessitates use of dedicated photographic printing paper and throw-away ink ribbon or sheets, so running costs are high, and further, the apparatus itself is expensive.

On the other hand, the ink-jet method is a method wherein droplets of ink are discharged from nozzles provided to a printer head, using methods such as electrostatic gravity, continuous vibration generation (piezo method), thermal (bubble-jet method), and the like, as described in Japanese Patent Publication No. 61-59911, Japanese Patent Publication No. 5-217, and so forth, whereby the droplets of ink adhere to the printing paper or the like, thereby conducting printing.

Accordingly, printing can be performed in plain paper, and ink ribbons or the like are not used, so running costs are low, and there are hardly any discarded items generated as with the case of using ink ribbons or the like. This method is becoming widespread in recent years, since color images can be easily printed.

However, the principle of the ink-jet method makes concentration gradients in pixels difficult, and it has been difficult to realize images with quality rivaling that of silver-salt color photography in a short time, as can be with the above-described dye dispersion thermal transfer method. That is to say, with the known ink-jet method, one droplet forms one pixel, so this principle makes concentration gradients within pixels difficult, and accordingly, high-quality images could not be realized. Also, pseudo-gradient representations with dithering using the high resolution of ink jets is being attempted, but image quality equal to that of the dye dispersion thermal transfer method has not been obtained, and moreover, the transfer speed drastically drops when employing such methods.

Recently, ink-jet methods which use thinned ink to obtain two or three gradients within a pixel are emerging, but it has been difficult to obtain image quality equal to that of silver-salt photography or dye dispersion thermal transfer methods, particularly with natural images or the like.

As for the electro-photography method, the running cost is low and transfer speed is high, but not only does the image quality not rival that of silver-salt photography, but the equipment is markedly expensive.

To summarize the above, none of these recording methods have satisfied all of the demands of image quality, running costs, equipment costs, transfer time, and so forth.

Hence, the so-called dye vaporization thermal transfer method (e.g., Japanese Unexamined Patent Publication No.

9-183239) has been proposed as a color printing method capable of satisfying all of the above demands.

Now, the structure surrounding the transfer portion near the tip of a printer head according to the known dye vaporization thermal transfer method will be described with reference to FIG. 27 and FIG. 28. Incidentally, FIG. 28 is an exploded cross-sectional view along line XXVIII—XXVIII in FIG. 27.

As shown in FIG. 28, this printer head (heater chip) 92 has a layered structure wherein, for example, a high-resistance poly-silicone film 82 serving as a heater (heat-generating element) is formed on a substrate 80 formed of silicone, via a silicone oxide ($SiO_2$) film 81. In the event that a thermal insulating substrate such as a quartz plate is to be used for the substrate 80, the high-resistance poly-silicone film serving as the heater can be directly formed on the substrate without a thermo-insulating layer such as the $SiO_2$ film 81.

Further, formed upon this poly-silicone film 82 are an individual electrode 83 and common electrode 84 formed of aluminum (Al) wiring patterning. Provided to the transfer portion 89 defined by the partition 86 and accessory wall 87 is a rough ink holding structure, this being formed of a great number of post-like members 88 having a width or diameter of around 2 $\mu$m and a height of around 6 $\mu$m being erected so as to leave minute gaps therebetween of around 2 $\mu$m.

FIG. 27 is a plan drawing of the portion around the transfer portion 89. As shown in FIG. 28, the poly-silicone film 82 serving as the heater is also formed under the electrodes 83 and 84, so the poly-silicone film 82 serves as a part of the wiring at the portions where the electrodes 83 and 84 exist, and serves as a resistance-heating heater 91 at the portions where the electrodes 83 and 84 do not exist thereupon.

Then, with a printer head upon which a plurality of transfer portions of such a configuration are arrayed, the heater 91 selected by the common electrode 84 and individual electrode 83 according to the image information to be printed is heated, ink (not shown in the diagram) supplied to the transfer portion (vaporizing unit) 89 from the ink supplying channel 90 defined by the accessory wall 87 and partition 86 in a spontaneous manner by capillary phenomena flies, thus being transferred onto a recording medium such as paper.

The above-described dye vaporization thermal transfer method consists of heating ink at the transfer portion of a printer head, causing the ink to fly by means of vaporization ablation, capillary waves, etc., by which the ink is caused to adhere to the surface of a recording medium (photographic printing paper) such as printer paper positioned so as to oppose the printer head across a gap of around 50 to 100 $\mu$m for example, thereby performing the transfer.

Also, as described above, provided to the transfer portion is a rough ink holding structure formed of a great number of post-like members having a width or diameter of around 2 $\mu$m and a height of around 6 $\mu$m being erected so as to leave minute gaps therebetween of around 2 $\mu$m, and a heater is provided below this ink holding structure, thus making up the vaporizing portion (transfer portion).

Providing the transfer portion with such an ink holding structure yields the following advantages (1) through (4):

(1) Ink is supplied to the vaporizing portion in a spontaneous manner by capillary phenomena.

(2) Ink can be effectively heated, due to the great surface area.

(3) Setting the height of the post-like members to an appropriate height allows a certain amount of ink to be held in the vaporizing portion at all times.

(4) The surface tension of liquid generally has negative temperature coefficients, so locally heated ink receives force toward the perimeter where the temperature is lower, but such movement can be suppressed to a minimum due to the ink holding structure, and deterioration of transfer sensitivity tends to be prevented.

Accordingly, an amount of ink according to the amount of heating by the vaporizing portion can be caused to fly, and to be transferred into the printer paper or the like, meaning that continuous control of the amount of ink transferred can be realized, i.e., gradation of concentration within a pixel can be realized. consequently, high-quality images rivaling that of silver-salt color photography can be obtained.

Also, there is no need to use an ink ribbon or the like, so running costs are low, and further, plain paper transfer can be realized by using ink which has high absorption properties with plain paper, which also can lower costs.

Also, this method takes advantage of vaporization, ablation, etc., of the ink, i.e., of the dye, so the transfer portion of the printer head which heats the ink does not need to be brought into contact with the recording medium such a printing paper, much less pressed against it at high pressure. Accordingly, the problem of thermal fusion between the portion for heating the ink such as the ink ribbon and the printer paper and the like, which could occasionally occur with other thermal transfer methods.

However, careful study by the present Inventor has shown that there is room for improvement with this known dye vaporization thermal transfer method printer.

That is, with this dye vaporization thermal transfer method printer in particular, one printer head contains a plurality of transfer portions (portions for causing ink to fly, or vaporizing portions; the term "transfer portion" will hereafter be understood to indicate such) in one or multiple columns as described above, and each heater generates heat according to the image information by the so-called resistance heating method, thus controlling the amount of ink transferred to the recording medium.

Accordingly, in the event that there are irregularities in the resistance values of each of the heat generating elements (heaters, resistance heating means or low-resistance portions; the term "heat generating element" will hereafter be understood to indicate such) provided to the multiple transfer portions, the amount of heat from Joule heat generates deviations for the same image information, which appear as irregularities in concentration within the transferred image. With the conventional structure for heat generating elements, the irregularities in resistance values within each of the heat generating elements could not be precisely controlled, resulting in deterioration in image quality.

This is due to the fact that aluminum, which is the principal component of the electrodes easily disperses into the poly-silicone which is the principal component of the heater, and dispersion of the aluminum into the poly-silicone occurs at the interface between the heater portion where no electrodes exist on the poly-silicone and the aluminum, owing to heat processing in the manufacturing processes such as the electrode formation step, or owing to own heat generated from the resistance heating means at the time of driving the recording apparatus, and further, the degree of dispersion differs from one heater to the next in the transfer portions, so there is the deviation of resistance values between the heaters. This will be described in further detail later.

In other words, in the event that the structure around the transfer portion is a configuration such as shown in FIG. 27 and FIG. 28, the resistance value of the heat generating element tends to shift to a value which is different from the desired value regarding the same image information, either at the process of manufacturing or over time, thus creating differences in the amount of heat generated by the heaters, resulting in irregularities in transfer concentration.

SUMMARY OF THE INVENTION

The present invention has been made in light of the above. Accordingly, it is an object of the present invention to provide a recording apparatus, configured of a transfer portion for holding recording material and a resistance heating means for heating the recording material such that the recording material is caused to fly, thereby transferring onto a recording medium disposed opposing the transfer portion to obtain a desired image, such as with the above-described dye vaporization thermal transfer method, and a method for manufacturing the recording apparatus, wherein irregularities in the resistance values of the above resistance heating means are suppressed, thus yielding high quality images.

That is, the present invention relates to a recording apparatus, comprising: a transfer portion for holding recording material; and a resistance heating means for heating the recording material such that the recording material is caused to fly, thereby transferring onto a recording medium disposed opposing the transfer portion; wherein the resistance heating means comprises a high-resistance portion provided adjacent to a low-resistance portion; and wherein electrodes for conducting to the high-resistance portion are connected to the low-resistance portion. This recording apparatus will hereafter be referred to as a "first recording apparatus according to the present invention".

With the first recording apparatus according to the present invention, a recording apparatus (particularly a printer head, the same hereafter) is configured of a transfer portion for holding recording material such as ink and a resistance heating means for heating the recording material such that the recording material is caused to fly, thereby transferring onto a recording medium such as photographic printing paper disposed opposing the transfer portion, as with the above-described dye-vaporizing thermal transfer method for example;

wherein the resistance heating means is comprised of a high-resistance portion provided adjacent to a low-resistance portion; and wherein electrodes such as individual electrodes and common electrodes for conducting to the high-resistance portion are connected to the low-resistance portion, and the high-resistance portion and electrodes are not in direct contact;

so dispersion of the material comprising the electrodes (particularly aluminum) to the material comprising the high-resistance portion (particularly poly-silicone) owing to heat processing in the manufacturing processes such as the electrode formation step, or owing to own heat generated from the resistance heating means at the time of driving the recording apparatus, can be prevented, thereby suppressing irregularities in the resistance values of the resistance heating means due to this dispersion and the like, consequently yielding images with high quality.

In other words, generally speaking, multiple (e.g., 256) transfer portions are provided to the recording head (printer head) of the recording apparatus, and according to the first recording apparatus of the present invention, the resistance values of each of the heat-generating elements in the aforementioned multiple transfer portions can be maintained at a desired value whether during the manufacturing process or over passage of time, so irregularities in the resistance values in each of the multiple transfer portions are prevented, there is no deviation regarding the same image information, and accordingly manifestation of concentration irregularities in the transferred image is suppressed, and an image that has high quality and is true to the above image information can be obtained.

Incidentally, with regard to the present invention, the aforementioned term "fly" includes the meaning of causing the above recording material to fly by vaporization, evaporation, ablation, or surface tension waves (i.e., causing the recording material to fly out in a mist form by using the force of impact of ink caused by surface tension convection (Marangoni flow) in the recording material generated by heat emitted from the above high-resistance portion) due to heating of the resistance heating means (i.e., the high-resistance portion), and it will be understood throughout this description that the term includes this meaning.

Also, the above "high-resistance portion" is an area which essentially comprises the above resistance heating means, and is a portion which has a resistance higher than the resistance of the above low-resistance portions. The greater the ratio between the high-resistance portion and low-resistance portion is, the better. For example, it is preferable that the ratio of high-resistance portion/low-resistance portion is 5 or more (more preferably, high-resistance portion/low-resistance portion=20 or more), and it is preferable that the resistance of the high-resistance portion be 100 Ω or greater but 20 KΩ or smaller (more preferably, 1 KΩ or greater but 5 KΩ or smaller).

Also, the present invention provides a method for manufacturing with good reproducibility the first recording apparatus configured of a transfer portion for holding recording material and a resistance heating means for heating the recording material such that the recording material is caused to fly, thereby transferring onto a recording medium disposed opposing the transfer portion, the method comprising; a step for creating a high-resistance portion provided adjacent to a low-resistance portion, to serve as the resistance heating means; and a step for forming electrodes on the low-resistance portion for conducting to the high-resistance portion. This method will hereafter be referred to as a "method for manufacturing the first recording apparatus according to the present invention".

Also, the present invention provides a recording apparatus, comprising: a transfer portion for holding recording material; and a resistance heating means for heating the recording material such that the recording material is caused to fly, thereby transferring onto a recording medium disposed opposing the transfer portion; wherein a barrier metal layer is disposed between the resistance heating means and the electrode conducting to the resistance heating means. This recording apparatus will hereafter be referred to as the "second recording apparatus according to the present invention".

With the second recording apparatus according to the present invention, a recording apparatus (particularly a printer head, the same hereafter) is configured of a transfer portion for holding recording material and a resistance heating means for heating the recording material such that the recording material is caused to fly, thereby transferring onto a recording medium disposed opposing the transfer portion, as with the above-described dye-vaporizing thermal transfer method for example;

wherein a barrier metal layer formed of material with a high melting point such as titanium or tungsten is disposed between the resistance heating means and the electrodes such as the individual electrodes and common electrodes for conducting to the resistance heating means;

so dispersion of the material comprising the electrodes (particularly aluminum) to the material comprising the high-resistance portion (particularly poly-silicone) owing to heat processing in the manufacturing processes such as the electrode formation step, or owing to own heat generated from the resistance heating means at the time of driving the recording apparatus, can be prevented, and at the same time, good conductivity between the resistance heating means and the electrodes can be realized, thereby suppressing irregularities in the resistance values of the resistance heating means due to this dispersion and the like, consequently yielding images with high quality.

DESCRIPTION OF THE PREFERRED EMBODIMENTS

Figure 1:
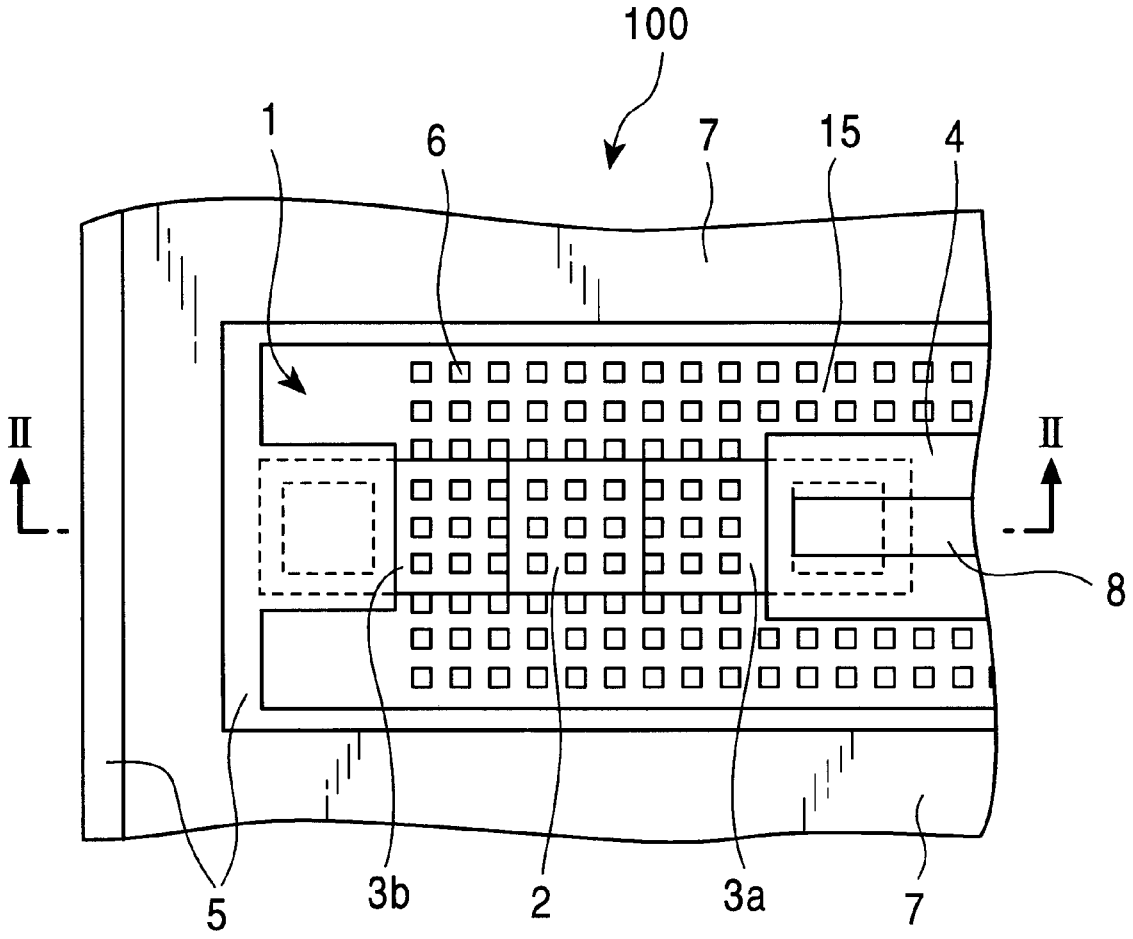
FIG. 1 is a schematic enlarged plan view of the transfer portion area of a printer head based on a first recording apparatus according to the present invention.

The first recording apparatus according to the present invention, and the manufacturing method thereof, will now be described.

Regarding the first recording apparatus according to the present invention, and the manufacturing method thereof, it is preferable that the low-resistance portions are provided adjacent to both sides of the high-resistance portion, and that the electrodes (e.g., common electrode and individual electrode) are connected to each of the low-resistance portions. The individual electrode may be an electrode to which certain image information is selectively applied, and the common electrode is provided to the printer head so as to be used in common.

It is also preferable that the high-resistance portion and low-resistance portions be of the same height or approximately the same height. Setting the high-resistance portion and low-resistance portions at the same height or approximately the same height facilitates easy formation of the materials to be disposed upon these resistance portions (e.g., $SiO_2$ film, recording material holding structure, etc.).

It is particularly preferable that neighboring portions within the same semiconductor material layer be doped with different concentrations of impurities, thereby forming the high-resistance portion and low-resistance portions. Such a structure can be realized by forming a semiconductor material layer on the substrate, and doping the neighboring portions within the semiconductor material layer with different concentrations of impurities.

For example, a poly-silicone layer serving as the above semiconductor material layer is formed on the substrate of $SiO_2$ by means of CVD (Chemical Vapor Deposition), ion injection of boron serving as the impurity is conducted for the entire surface thereof at a certain concentration, following which a mask is placed over the area to which the high-resistance portions are to be formed, then ion injection of boron serving as the impurity is conducted to the low-resistance portion at a certain concentration, consequently injecting impurities (ions) to the masked areas and neighboring areas at differing concentrations. This process can be performed with great ease and precision, without involving a step in which particles from edging or the like are generated in great numbers.

However, regarding the first recording apparatus according to the present invention, and the manufacturing method thereof, the present invention is by no means restricted to a configuration such as described above for the high-resistance portion and low-resistance portions; rather, the high-resistance portion and low-resistance portions may be formed of differing materials, e.g., the high-resistance portion may be formed of poly-silicone by CVD and the low-resistance portion be formed of silicone doped with impurities. Also, the pattern of the high-resistance portion and low-resistance portions is not restricted to the above described arrangement; rather, many variations may be made. Further, one transfer portion may have multiple high-resistance portions.

Also, it is preferable that a barrier metal layer be formed between the low-resistance portion and the electrodes.

For example, a barrier metal layer formed of a layered structure of material with a high melting point such as titanium or tungsten being disposed at the conducting portion between the low-resistance portion and the electrodes realizes good Ohmic contact between the low-resistance portion and the electrodes, and at the same time prevents dispersion of material forming the electrodes to the material forming the low-resistance portion (or vice versa).

Also, it is preferable that a protective layer be formed over the high-resistance portion and low-resistance portions, and further that electrode connection holes are opened in the protective layer so as to encounter the low-resistance portion.

With the method for manufacturing the first recording apparatus according to the present invention as described above, so it is preferable that a semiconductor material layer be formed on a substrate, and neighboring portions within this same semiconductor material layer be doped with different concentrations of impurities, thereby forming the high-resistance portion and low-resistance portions. At the time of performing annealing processing following such doping with impurities, it is preferable that a protective layer of $SiO_2$ for example be formed over the semiconductor material layer doped with the impurities, following which the annealing is performed, thereby preventing evaporation of the impurities at the time of annealing due to the capping action of the protective layer, thus allowing the high-resistance portion and low-resistance portions to be formed to desired resistance values with high precision.

Also, while described in detail later, regarding the first recording apparatus according to the present invention, and the manufacturing method thereof, it is preferable that the transfer portion have a recording material holding structure (hereafter referred to as "ink holding structure") on the resistance heating means for holding the recording material by capillary phenomena. It is further preferable that the recording material holding structure have a plurality of minute gaps, the recording material being held in the minute gaps by capillary phenomena.

That is to say, the transfer portion may be provided with a rough recording material holding structure formed of a great number of post-like members having a width or diameter of around 2 $\mu$m and a height of around 6 $\mu$m being erected so as to leave minute gaps therebetween of around 2 $\mu$m, as providing the transfer portion with such an recording material holding structure yields the following advantages:

Recording material is supplied to the transfer portion in a spontaneous manner by capillary phenomena.

Recording material can be effectively heated, due to the great surface area.

Setting the height of the post-like members to am appropriate height allows a certain amount of recording material to be held in the transfer portion at all times.

The surface tension of liquid generally has negative temperature coefficients, so locally heated recording material receives force toward the perimeter where the temperature is lower, but such movement can be suppressed to a minimum due to the recording material holding structure, and deterioration of transfer sensitivity is prevented.

Figure 28:
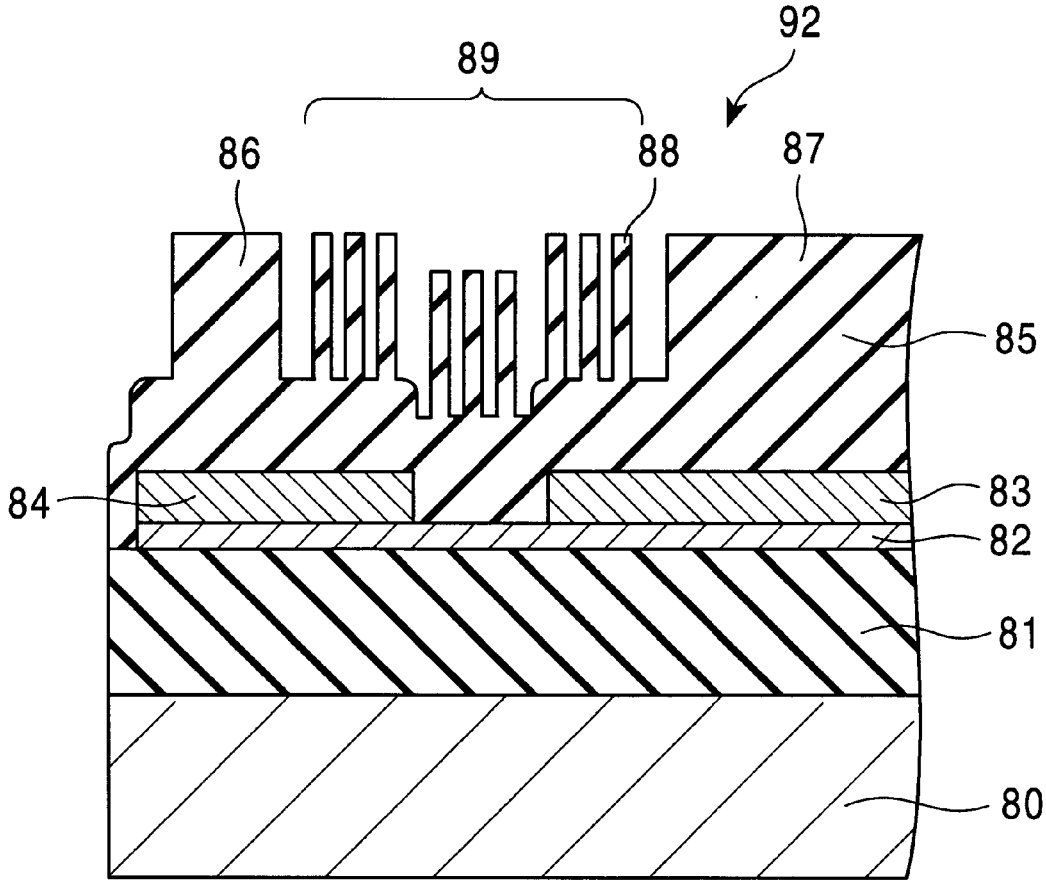
FIG. 28 is a schematic enlarged cross-sectional view of the transfer portion area of the printer head according to the same.

Also, as described above, the upper plane of the recording material holding structure can be easily formed into a flat plane in the event that the high-resistance portion and low-resistance portions are formed at the same height or approximately the same height. Of course, even in cases wherein the upper plane of the recording material holding structure does not form a flat plane (e.g., a case such as shown in FIG. 28 wherein the arrangement is stepped), such a recording material holding structure can be formed suitably, but with arrangements wherein the upper plane of the recording material holding structure forms a flat plane, ease of masking is facilitated, and there is no difference in resolution owing to stepped structures, so the minute post-like members can be formed into even better forms by anisotropic etching or the like.

Also, the present invention is particularly advantageous in arrangements wherein the resistance heating means is formed of poly-silicone, and the electrodes are formed primarily of aluminum.

That is to say, in the event that aluminum is used as the principal component of the electrodes, and poly-silicone is used as the principal component of the resistance heating means, dispersion of the aluminum into the poly-silicone may occur at the interface between the resistance heating means formed of poly-silicone and the electrodes formed of aluminum, owing to heat processing in the electrode formation step, or owing to own heat generated from the poly-silicone as a heat-generating element at the time of printing with the printer head, but according to the present invention, such dispersion can be prevented, and the resistance heating means and the electrodes conducting thereto can be formed with the desired conductivity.

Next, an embodiment of the first recording apparatus according to the present invention will be described.

Figure 2:
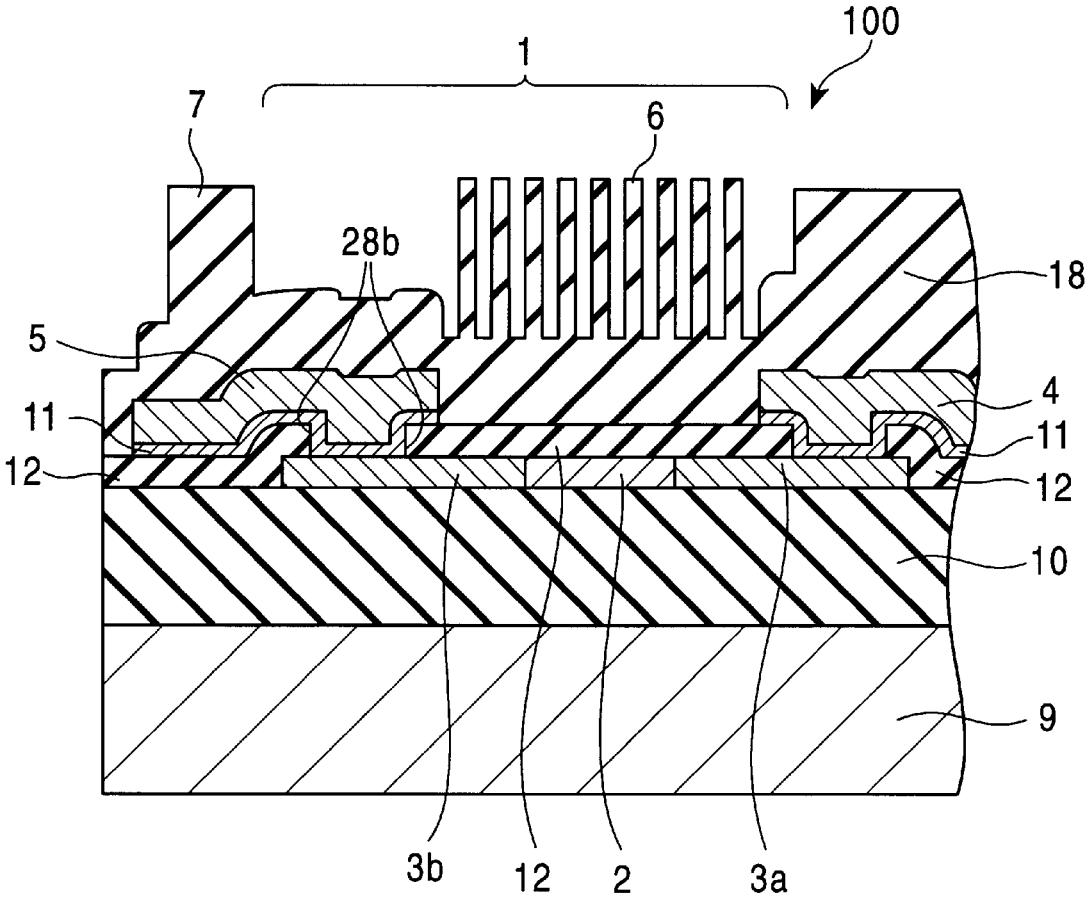
FIG. 2 is a schematic enlarged cross-sectional view of the transfer portion area of a printer head according to the same.
Figure 3:
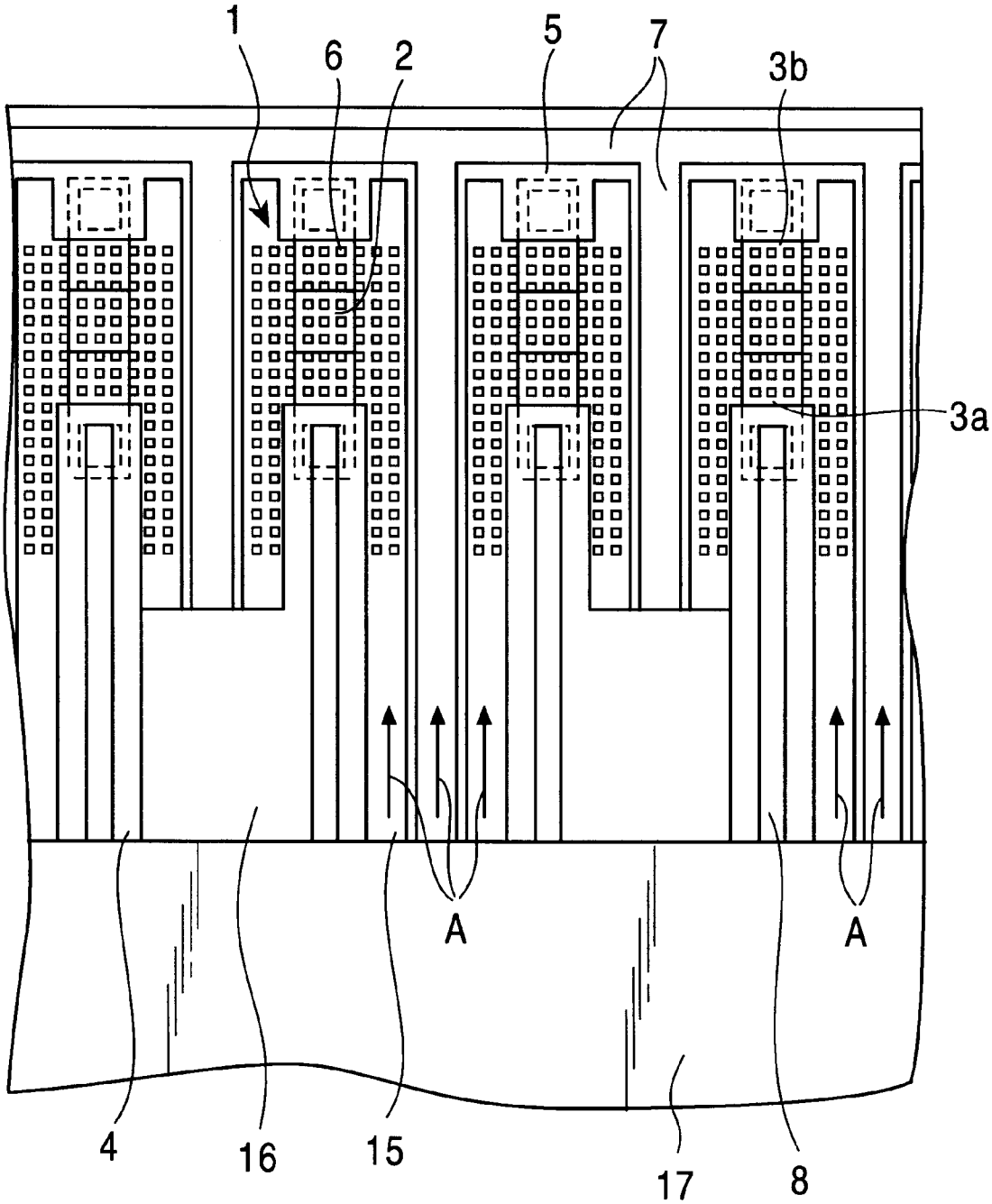
FIG. 3 is another schematic plan view of the transfer portion area of a printer head according to the same.

First, FIG. 1 is a schematic enlarged plan view of the transfer portion area of a first recording apparatus (particularly, a printer head) according to an embodiment of the present invention. FIG. 2 is also a schematic enlarged cross-sectional view of this transfer portion area (with FIG. 2 being a cross-sectional view along line II—II in FIG. 1, exaggerated fivefold in the vertical direction). FIG. 3 is a detailed plan view of the transfer portion provided to the tip of a printer head, and the surrounding area.

As shown in FIG. 2, the printer head 100 according to the present embodiment has a substrate 9 formed of silicone, for example, as the base thereof, and a poly-silicone film is formed on this substrate 9 via a silicone oxide ($SiO_2$) film serving as a thermal insulating layer 10. This poly-silicone film becomes the high-resistance portion 2 serving as a heater, and the low-resistant portions 3*b* and 3*a* (or low-resistant portion 3) respectively connected to the common electrode 5 and individual electrode 4 formed of an aluminum (or, aluminum to which a second element has been added, such as Al—Si, Al—Cu) wiring pattern, for example. Incidentally, in the event that a thermal insulating substrate such as a quartz plate is to be used as the substrate 9, the high-resistance poly-silicone film can be directly formed on the substrate without a thermo-insulating layer 10 such as the $SiO_2$ film.

Also, a $SiO_2$ film for example is formed as a protective film 12 on the poly-silicone film comprising the high-resistance portion 2 and the low-resistance portions 3*a* and 3*b*, and openings (or "electrode connecting holes") 28*a* and 28*b* are opened for providing conduction between the low-resistance portions 3*a* and 3*b* and the individual electrode 4 and common electrode 5. It is preferable that these openings 28*a* and 28*b* be 2 to 3 $\mu$m or more (or 5 $\mu$m or more) from the border between the high-resistance portion 2 and the low-resistance portions 3*a* and 3*b*, from the perspective of workability of the ink holding structure formed on the top, and the above-described dispersion.

Also, a barrier metal layer 11 formed of metal with high melting points such as Ti, W, Cr, or the like, is formed at the connecting point between the electrodes 4 and 5 formed primarily of aluminum and the low-resistance portions 3*a* and 3*b*, thus preventing dispersion of the aluminum which is the principal component of the electrodes 4 and 5 to the poly-silicone which is the principal component of the low-resistance portions 3*a* and 3*b*, and further realizing Ohmic contact between the low-resistance portions 3*a* and 3*b* and the electrodes 4 and 5.

In the poly-silicone film, the high-resistance portion 2 serves as the heater for resistance heating (i.e., the resistance heating means), but does not come into direct contact with the individual electrode 4, common electrode 5, or barrier metal layer 11, so there is no dispersion of aluminum or the like which is the principal component of the electrodes 4 and 5 to the high-resistance portion 2. Accordingly, the phenomena wherein the resistance values of each of the heat-generating elements within the same head change and cause deviation, owing to heat processing in the manufacturing processes such as the electrode formation step, or owing to own heat generated from the resistance heating means at the time of printing with the printer head, can be amply prevented. The high-resistance portions 2 selected by the common electrode 5 and individual electrodes 4 according to the image information to the printed are heated, causing the ink thereupon to fly and be transferred onto a recording medium such as photographic printing paper.

For example, a heater chip (printer head) has 256 high-resistance portions (heaters) of approximately 20 $\mu$m by 20 $\mu$m in size formed at approximately 85 $\mu$m cycles, with each heater corresponding to the transfer of each dot, so resolution of 300 dpi is realized.

Also, with the present embodiment, as shown in FIG. 2, an $SiO_2$ layer 18 which acts to protect the electrodes 4 and 5 is formed over the entire surface including the protective layer 12, and electrodes 4 and 5. As shown in FIG. 1 and FIG. 3, a partition 7 which surrounds the transfer portion 1 and defines a supplying channel 15 for supplying ink to the transfer portion 1, and the post-like members 6 forming the ink holding structure in the transfer portion 1, are both formed as part of this $SiO_2$ layer 18. That is, for example, the $SiO_2$ layer 18 formed to a certain thickness by the CVD method is subjected to anisotropic etching by means of RIE (Reactive Ion Etching), to a certain thickness using an etching mask with a certain pattern, thereby simultaneously forming the partition 7, post-like members 6, and the portion of the electrode protecting film other than these. Also, as shown by implied lines in the Figure, the $SiO_2$ layer 18 may have in the surface thereof a depression following the surface form of the individual electrode 4 serving as the base thereof.

Also, as shown in FIG. 1 and FIG. 3, post-like members 6 are formed on the transfer portion 1 in a square matrix of 9 by 9, for example, so as to serve as the ink holding structure, and the nine post-like members in a 3 by 3 formation at the center are positioned above the high-resistance portion 2 serving as a heater. The size of each of the post-like members 6 is, e.g., around 0.2 to 10 $\mu$m in width and around 2 to 15 $\mu$m in height, these being arrayed with gaps of 0.2 to 10 $\mu$m between each. The form of the post-like members is not restricted to square post-like member shapes as shown in the Figure, and may be round, for example, instead. Also, the ink holding structure is not restricted to a collection of minute post-like members, but rather may be a woven structure, instead.

Particularly, according to the present embodiment, the high-resistance portion 2 and low-resistance portion 3 are provided at the same height or approximately the same height, so the surface of the $SiO_2$ layer 18 formed thereupon is flat at this portion, thus facilitating ease of working the post-like members 6 comprising the ink holding structure. In other words, difference in resolution owing to stepped structures does not easily occur at the time of masking for creating the post-like members 6, and the worked form of the post-like members is good.

Also, as shown in FIG. 3, the supply channel 15 for supplying ink to each of the transfer portions 1 is defined by partitions 7 approximately the same height as the post-like members 6 in the transfer portions 1. Further, as described above, an accessory wall 8 is provided at a position in the supply channel 15 approximately halfway between the pair of partitions 7 defining the supply channel 15. Moreover, the ink holding structure pattern of the post-like members 6 in the transfer portion 1 is extended to the portion between the pair of partitions 7 defining the supply channel 15 and the accessory wall 8. This accessory wall 8 has approximately the same height as the above-described partitions and post-like members.

Now, description will be made regarding how this accessory wall 8 works. The transfer portion 1 holds ink by means of capillary phenomena which occurs between the opposing solid partitions and the post-like members. For example, though omitted in the Figures, in the event that liquid between two vertical partitions wets the surface of the partitions, the surface level of the liquid is drawn up to a height which is determined by the angle of contact between the liquid and the partition surfaces, the surface tension of the liquid, and the distance between the partitions. In the case of the present embodiment, the height of the partitions 7 and the post-like members 6 in each transfer portion 1 is lower than the above-described height, so the surface level of the ink is maintained at approximately the height of the partitions 7 and the post-like members 6.

That is to say, in the present embodiment, as shown in FIG. 1 and FIG. 3, an accessory wall 8 is provided at a position approximately halfway between the pair of partitions 7 defining each supply channel 15. Providing such an accessory wall 8 means that the gap between the accessory wall 8 and the partition 7 is less than half that of the gap between the pair of partitions 7 in an arrangement wherein the accessory wall 8 is not provided. Accordingly, the surface level of the ink in the supplying channel 15 rises, facilitating supplying of ink to each transfer portion 1. This accessory wall is provided at a suitable distance from the transfer portion 1.

Next, as shown in FIG. 3, an ink channel for supplying ink from an ink storage unit omitted in the Figures to these supplying channels 15 is formed in the shape of a tunnel, by partitions comprised of a pattern of sheet resist 16 for example, and a lid member formed of a nickel (Ni) sheet 17, for example.

At the transfer portion 1 at this time, as shown in FIG. 3, the partitions formed of the sheet resist 16 are provided to a position retracted by around 100 $\mu$m from the center of the high-resistance portion 2 serving as the heater for the transfer portion 1, and the lid member is provided to a position further retracted by around 100 $\mu$m from that position. This arrangement prevents excessive ink from being provided to the transfer portion 1. In the event that excessive ink is provided to the provided to the high-resistance portion 2, the energy necessary for causing the ink to fly increases, thus decreasing the transfer efficiency. Also, such an arrangement keeps the partitions formed of the sheet resist 16 and the lid member formed of the Ni sheet 17 from coming into contact with the recording medium such as paper, positioned opposing the transfer portion 1.

In other words, as shown by the arrow A in FIG. 3, the ink which flows down the ink channel defined by the partitions formed of the sheet resist 16 is separated by the partitions 7 defining the supply channels 15 in front of each of the transfer portions 1, according to the decrease in liquid level therein, and flows into the supply channel 15. In the supply channels 15, the ink is maintained at approximately the same height as the upper surface of the partitions 7, accessory wall 8, and post-like members 6. Thus, providing ink holding structures formed of post-like members 6 to each of the transfer portions 1 maintains the ink at a constant level within each of the transfer portions 1.

Also, regarding the transfer portions 1, the ink spent by heating of the high-resistance portion 2 serving as the heater is spontaneously supplied onto the heater by capillary action owing to the existence of the post-like members 6. The flow of ink from the ink storage unit omitted in the Figures to the transfer portions 1 all occurs by this spontaneous flow.

Figure 5:
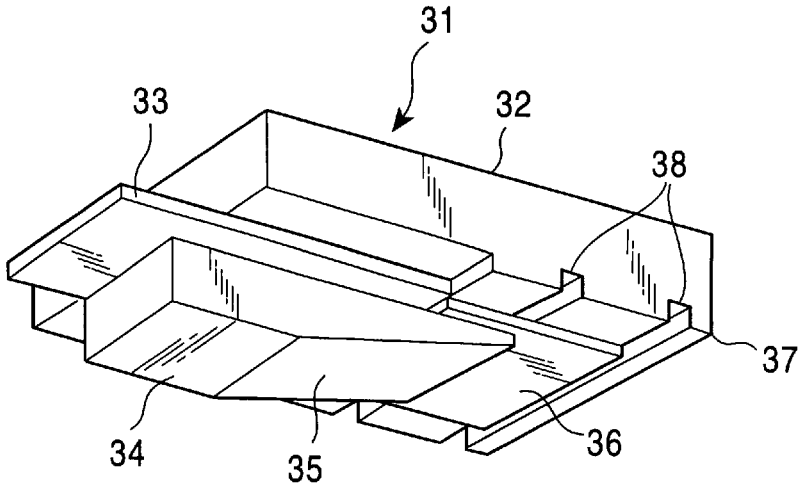
FIG. 5 is a schematic perspective view of the exterior of a printer head based on the present invention.
Figure 6:
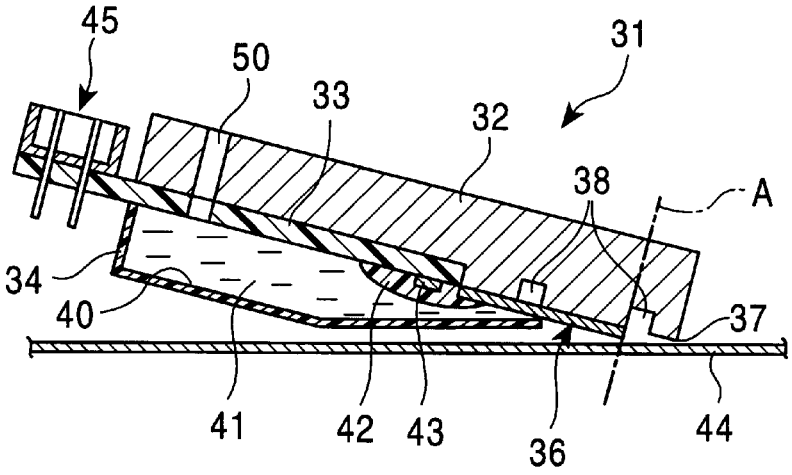
FIG. 6 is a schematic cross-sectional diagram illustrating a recording method with the printer head according to the same.
Figure 7:
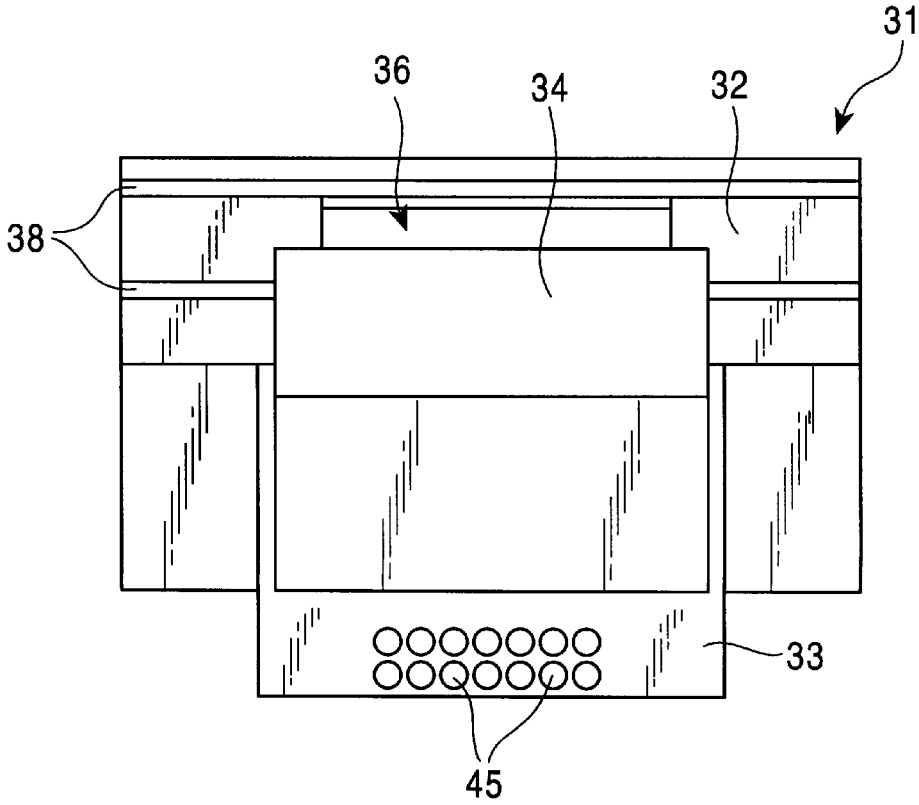
FIG. 7 is a schematic lower view of the printer head according to the same.
Figure 8:
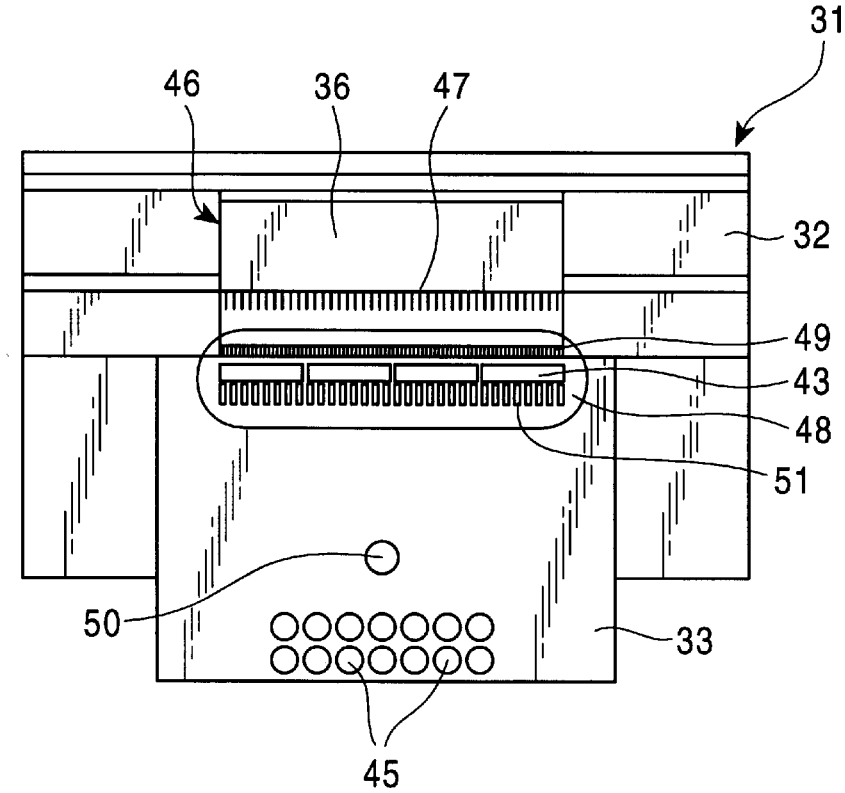
FIG. 8 is a schematic lower view of the printer head according to the same, with the cover thereof removed.

Next, FIG. 5 is a schematic perspective view of the exterior of a printer head based on the present invention, FIG. 6 is a schematic cross-sectional diagram illustrating a method of recording on a recording medium such as printing paper or the like with this printer head, FIG. 7 is a lower view of this printer head, and FIG. 8 is a lower view of the cover of the ink storage unit of the printer head removed.

As can be understood from these drawings, the printer head 31 has a head base 32 formed of aluminum (Al), for example, also serving as a heat sink. The above-described transfer portion and the like are attached to the tip-most portion of the lower plane of this head base 32, such as a heater chip 36 formed on a silicone substrate being attached by means of a silicone adhesive agent, for example. Also, the position indicated by the single-dot broken line A in FIG. 6 is the center of flying ink of the above transfer portion. In order that the heater chip 36 is applied evenly to the portion of adhesion, grooves 38 are provided to the surface of the head base 32. Thus, any excessive adhesive agent can escape from these grooves 38 at the time of applying the heater chip 36.

Also, a printed board 33 mounted with a driver IC 43 (see FIG. 6 and FIG. 8) for driving heat generation is also applied to the head base 32 with a silicone adhesive agent, for example. As shown in FIG. 6, the portion to which the printed board 33 is attached to this head base 32 is depressed by an amount corresponding to the thickness of the printed board 33, so that once the printed board 33 is attached to the depression, the height thereof including the driver IC 43 mounted thereupon is approximately the same height as the upper surface of the heater chip 36 provided alongside the printed board 33.

Also, a silicone coating material JCR (Junction Coating Resin) 48 is applied and subjected the thermal hardening at the junctions between the electrode pattern 49 on the heater chip 36 (see FIG. 8) and the driver IC 43, and between the driver IC 43 and the wiring pattern 51 on the printed board 33 (see FIG. 8), so as to protect the connecting bonding wires for example at the connections, the bonding wires having been omitted in the drawings.

As shown in FIGS. 5 through 7, a cover 34 is applied to an area covering part of the printed board 33 and part of the heater chip 36, by a silicone adhesive agent, as described above. On the other hand, as shown in FIG. 6 and FIG. 8, provided to the head base 32 and the printed board 33 is an ink introducing hole 50 passing through both. The arrangement is such that, for example, ink 41 from an ink tank off of the drawing that has been supplied through a flexible pipe or the like omitted in the drawings passes through the ink introducing hole 50, is supplied to an ink storage unit 40 formed within the cover 34, so that the ink 41 is further supplied from the ink storage unit 40 to the transfer portions (not shown) at the tip of the heater chip 36, via a great number of ink supplying channels formed of a great number of partitions formed of sheet resist 47 and lid materials formed of the Ni sheet 46, as shown in FIG. 8.

As shown in FIG. 6, at the time of printing, the printer head 31 is held at a certain angle against the photographic printing paper 44 in a state wherein the tip 37 of the head base 32 at the side where the heater chip 36 is provided. Accordingly, the gap between the transfer portion (not shown) at the center A of the flying ink and the photographic printing paper 44 is maintained at a constant gap, e.g., 50 to 500 $\mu$m.

At this time, as shown in FIG. 5 and FIG. 6, an inclined plane 35 corresponding to the angle of inclination between the printer head 31 and the photographic printing paper 44 has been provided beforehand to the cover 34 attached to the printer head 31, so that the cover 34 does not interfere with printing. Incidentally, in FIGS. 6 through 8, connector terminals 45 for connecting the wiring of the printed board 33 to an FPC (Flexible Print Circuit), for example, off of the drawings, are provided to the printed board 33.

Next, examples will be described regarding cases of using the printer head according to the present embodiment in a serial printer and a line printer, with reference to FIG. 9 and FIG. 10.

Figure 9:
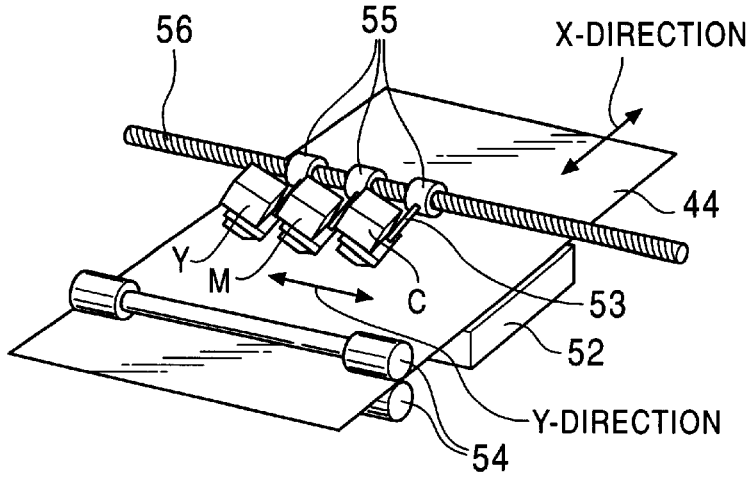
FIG. 9 is a schematic external view illustrating the configuration of a serial-type color printer.

In the case of the serial printer shown in FIG. 9, printer heads for the colors yellow (Y), magenta (M), and cyan (C) are arrayed in a direction perpendicular to the feeding direction of the photographic printing paper 44 (the X-axial direction in the drawing), i.e., in the Y-axial direction in the drawing. Incidentally, a black printer head may be further added to this arrangement. The printer heads Y, M, and C are fixed to moving pieces 55 which are attached to a feeding shaft 56 by linking members 53. Rotation of the feeding shaft 56 by a driving force off of the drawing causes the printer heads to move reciprocally in the Y-axial direction in the Figure. On the other hand, the photographic printing paper 44 is fed in the X-axial direction in the Figure by a feeding roller 54, corresponding with scanning of each line by the printer heads, so that each printer head prints on the photographic printing paper 44 at a position between the printer head and platen 52.

Figure 10:
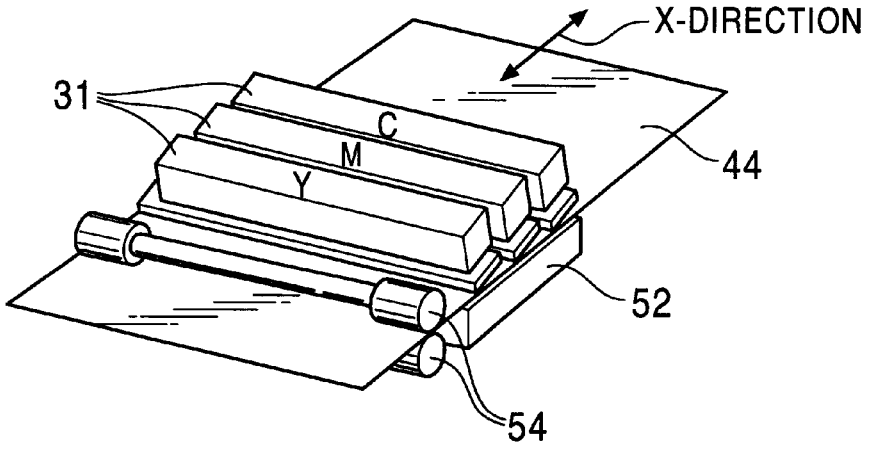
FIG. 10 is a schematic external view illustrating the configuration of a line-type color printer.

On the other hand, in the case of the line printer shown in FIG. 10, printer heads 31 for the colors yellow (Y), magenta (M), and cyan (C) are each extended in a direction perpendicular to the feeding direction of the photographic printing paper 44 (the X-axial direction in the drawing), i.e., in the line direction. Incidentally, a black printer head may be further added to this arrangement. The photographic printing paper 44 is fed in the X-axial direction in the Figure by a feeding roller 54, so that each printer head prints in units of lines on the photographic printing paper 44 at a position between the printer head and platen 52.

As described above, according to an embodiment of the first recording apparatus of the present invention, the resistance heating means is formed of a high-resistance portion 2 provided adjacent to low-resistance portions 3*a* and 3*b*, and electrodes such as individual electrodes 4 and common electrodes 5 for conducting to this high-resistance portion 2 are directly connected to the low-resistance portions 3*a* and 3*b* so that the high-resistance portion 2 and the electrodes 4 and 5 are not in direct contact, so dispersion of the aluminum comprising the electrodes to the poly-silicone comprising the high-resistance portion owing to heat processing in the process for forming the electrodes, or owing to own heat generated from the resistance heating means at the time of driving the recording apparatus, can be prevented. Also, the high-resistance portion 2 receives conduction of electricity through the connections of the low-resistance portions 3*a* and 3*b*, and the electrodes 4 and 5, so better Ohmic contact can be realized as described alter, as compared with an arrangement wherein the electrodes are directly connected with the high-resistance portion (resistance heating means) 2 serving as the heater. Accordingly, irregularities in the resistance values of the resistance heating means owing to such dispersion and the like can be suppressed, thus yielding high-quality images.

In other words, in the event that 256 transfer portions (i.e., 256 heaters) are provided to a printer head of a recording apparatus, the resistance values of the heaters (resistance heating means) in the multiple transfer portions may be unequal due to the above dispersion and the like, but according to the present embodiment, the heaters at the transfer portions can be set precisely so that the resistance values thereof are the desired value regardless of heat processing at the time of manufacturing or generation of heat over time due to use, there is no deviation regarding the same image information, manifestation of concentration irregularities in the transferred image is suppressed, and an image that has high quality and is true to the image information can be obtained.

Next, description will be made regarding the second recording apparatus according to the present invention.

With the second recording apparatus according to the present invention, regarding the resistance heating means, the transfer portion may have a recording material holding structure for holding the recording material by capillary phenomena. Further, the recording material holding structure may have a plurality of minute gaps, the recording material being held in the minute gaps by capillary phenomena.

That is to say, the transfer portion may be provided with a recording material holding structure formed of a great number of post-like members having a width or diameter of around 2 $\mu$m and a height of around 6 $\mu$m being erected so as to leave minute gaps therebetween of around 2 $\mu$m, as providing the transfer portion with such a recording material holding structure yields the following advantages:

Ink is supplied to the transfer portion in a spontaneous manner by capillary phenomena.

Recording material can be effectively heated, due to the great surface area.

Setting the height of the post-like members to an appropriate height allows a certain amount of recording material to be held in the transfer portion at all times.

The surface tension of liquid generally has negative temperature coefficients, so locally heated recording material receives force toward the perimeter where the temperature is lower, but such movement can be suppressed to a minimum due to the ink holding structure, and deterioration of transfer sensitivity is prevented.

Also, the present invention is particularly advantageous in arrangements wherein the resistance heating means is formed of poly-silicone, and the electrodes are formed primarily of aluminum.

That is to say, in the event that aluminum is used as the principal component of the electrodes, and poly-silicone is used as the principal component of the resistance heating means, dispersion of the aluminum into the poly-silicone which might otherwise occur at the interface between the resistance heating means formed of poly-silicone and the electrodes formed of aluminum, owing to heat processing in the electrode formation step, or owing to own heat generated from the poly-silicone as a heat-generating element at the time of printing with the printer head, can be prevented.

Next, an embodiment of the second recording apparatus according to the present invention will be described.

Figure 4:
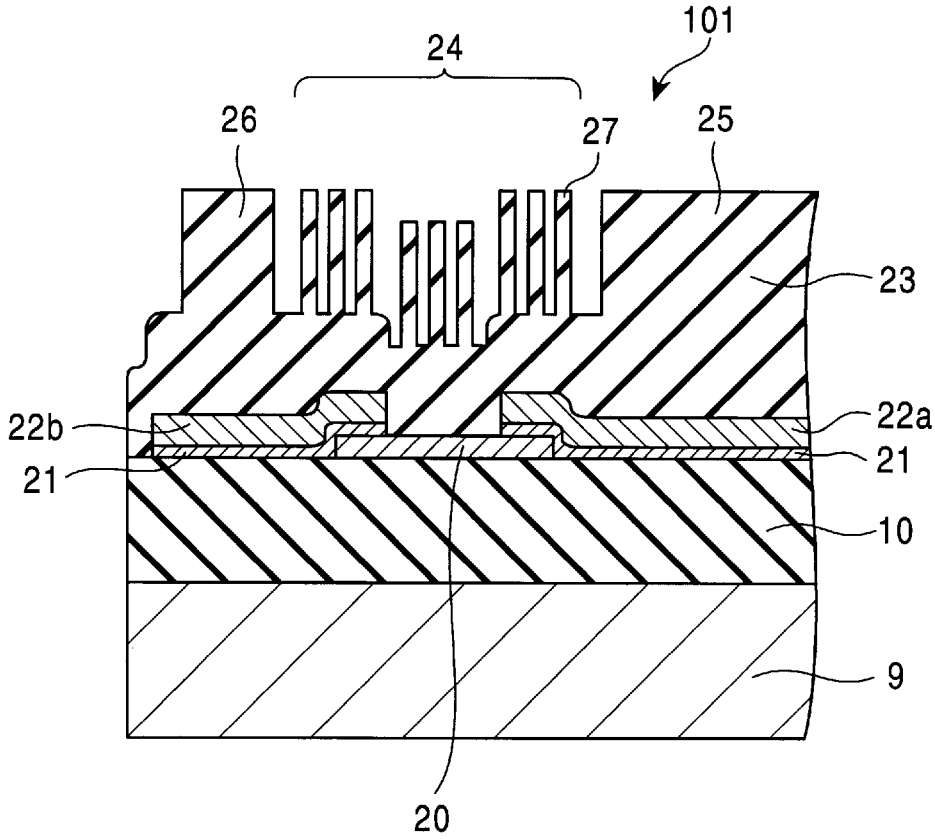
FIG. 4 is a schematic enlarged cross-sectional view of the transfer portion area of a printer head based on a second recording apparatus according to the present invention.

FIG. 4 is a schematic enlarged cross-sectional view of the transfer portion area of a printer head based on a recording apparatus according to the present invention.

As shown in FIG. 4, the printer head 101 according to the second recording apparatus of the present invention has a substrate 9 formed of silicone, for example, as the base thereof, and a poly-silicone resistance heating means 20 is formed on this substrate 9 via a silicone oxide ($SiO_2$) film serving as a thermal insulating layer 10. In the event that a thermal insulating substrate such as a quartz plate serving as the substrate 9 is to be used, the high-resistance poly-silicone film can be directly formed on the substrate without a thermo-insulating layer 10 such as the $SiO_2$ film 10.

Also, the individual electrode 22*a* and common electrode 22*b* formed of aluminum are configured so as to conduct electricity to the resistance heating means 20 via a barrier metal layer 21 formed of metal with high melting points such as Ti, W, Cr, or the like, thus preventing dispersion of the aluminum which is the principal component of the electrodes 22*a* and 22*b* to the poly-silicone which is the principal component of the low-resistance portions.

Accordingly, the phenomena wherein the resistance values of each of the heat-generating elements within the same head change and cause deviation, owing to heat processing in the manufacturing processes such as the electrode formation step, or owing to own heat generated from the resistance heating means 20 serving as the heater at the time of printing with the printing head, can be amply prevented. The resistance heating means 20 selected by the common electrode 22*b* and individual electrodes 22*a* according to the image information to the printed are heated, causing the ink thereupon to fly and be transferred onto a recording medium such as photographic printing paper.

For example, a heater chip has 256 high-resistance portions (heaters) of approximately 20 $\mu$m by 20 $\mu$m in size formed at approximately 85 $\mu$m cycles, with each heater corresponding to the transfer of each dot, so resolution of 300 dpi is realized.

Also, an $SiO_2$ layer 23 which acts to protect the electrodes 22*a* and 22*b* is formed over the entire surface including the electrodes 22*a* and 22*b*. A partition 26 which surrounds the transfer portion 24 and defines a supplying channel for supplying ink to the transfer portion 24, and post-like members 27 forming the ink holding structure in the transfer portion 24, are both formed as part of this $SiO_2$ layer 23. That is, for example, the $SiO_2$ layer 23 formed to a certain thickness by the CVD method is subjected to anisotropic etching by means of RIE to a certain thickness using an etching mask with a certain pattern, thereby simultaneously forming the partition 24, post-like members 27, and the portions of the electrode protecting film other than these.

Also, at the transfer portion 24, post-like members 27 are formed in a square matrix of 9 by 9, for example, so as to serve as the ink holding structure, and the nine post-like members in a 3 by 3 formation at the center are positioned above the resistance heating means 20 serving as the heater. The size of each of the post-like members 27 is, e.g., around 0.2 to 10 $\mu$m in width and around 2 to 15 $\mu$m in height, these being arrayed with gaps of 0.2 to 10 $\mu$m between each. The form of the post-like members is not restricted to square post-like member shapes as shown in the Figure, and may be round, for example, instead.

Also, the supply channel for supplying ink to the transfer portions 24 is defined by partitions 26 approximately the same height as the post-like members 27 in the transfer portions 24. Further, as described above, an accessory wall 25 is provided at a position approximately halfway between the pair of partitions defining the supply channel, and the ink holding structure pattern of the post-like members 27 in the transfer portion 24 is extended to the portion between the pair of partitions 26 defining the supply channel and the accessory wall 25. This accessory wall 25 works in the same manner as that described earlier, and has approximately the same height as the above-described partitions and post-like members.

Also, the mechanism for supplying ink to the transfer portion 24 is essentially the same mechanism as the mechanism in the embodiment of the first recording apparatus according to the present invention, shown in FIG. 3.

Also, a schematic perspective view of the exterior of a printer head based on the present embodiment, a schematic cross-sectional diagram illustrating the state of transferring onto printing paper or the like with this printer head, a lower view of this printer head, and a lower view of the cover of the ink storage unit of the printer head removed, are shown in FIGS. 5 through 8, as with the above-described first recording apparatus according to the present invention.

Further, examples regarding cases of using the printer head according to the present embodiment in a serial printer and a line printer, are shown in FIG. 9 and FIG. 10, as with the above-described embodiment of the first recording apparatus according to the present invention.

As described above, according to an embodiment of the second recording apparatus of the present invention, a barrier metal layer 21 formed of material with a high melting point such as titanium, tungsten, chrome, or the like is disposed between the resistance heating means 20 and the electrodes such as the common electrode 22*b* and individual electrodes 22*a*, so dispersion of the aluminum comprising the electrodes 22*a* and 22*b* to the poly-silicone comprising the resistance heating means 20 owing to heat processing in the process for forming the resistance heating means 20 and the electrodes 22*a* and 22*b*, or owing to own heat generated from the resistance heating means 20 at the time of driving the printer head, can be prevented. Accordingly, irregularities in the resistance values of the individual resistance heating means in the transfer portions 24 of the heater chips 101 owing to such dispersion and the like can be suppressed, thus yielding high-quality images.

In this way, according to the first recording apparatus of the present invention and the second recording apparatus of the present invention, change in the resistance values of each of the heat-generating elements within the same head because of dispersion of the electrode material and heater material, owing to heat processing in the electrode formation step, or owing to own heat generated from the poly-silicone being driven as the heater at the time of printing with the printer head can be suppressed, and thus the resistance values of the heaters within a printer head can be made to be uniform for the same image data, so the amount of heat emitted the each of the heaters can be made to be uniform, meaning that high-quality images with few irregularities in concentration can be obtained. Also, there are no irregularities between the heaters generated over time owing to own heat generated by driving printing head, so there is little deterioration overtime, consequently providing a printer head with high durability.

Also, by means of controlling the energy supplied to each heater according to the image data to be printed, the amount of ink discharged by causing the ink to fly can be continuously controlled, thereby obtaining high-quality images with sufficiently high optical concentration that can have multi-value concentration gradations.

Further, the printer head according to the present invention is basically a thermal-transfer type printer head, and thus has characteristics enabling miniaturization, ease of maintenance, immediate availability, high image quality, high gradation capabilities, and so forth.

It should be noted that the printer head according to the present invention is by no means restricted to dye-vaporization thermal transfer type printer heads as described above, but can be applied to other methods wherein recording material is caused to fly due to resistance heating means (e.g., thermal-type ink-jet method, etc.).

Now, regarding the relation between the high-resistance portion and low-resistance portion in the above embodiment; in the event that the resistance value of the "low-resistance portion" increases, voltage drops at that portion as well, meaning that energy is spent at the "low-resistance portion" due to generation of heat. The portion which originally is to be used for generating heat is the "high-resistance portion", so generation of heat at the "low-resistance portion" is a loss of input energy. Accordingly, the greater the ratio of resistance values between the two is, the better.

It is thought that generation of heat at portions other than the above high-resistance portion in dye-vaporization thermal transfer arrangements, which perform liquid surface control by change in ink temperature, acts negatively regarding thermal design as well. With current printer heads, the resistance value of the "high-resistance portion" is mainly determined by restrictions of the driving circuitry and power source, and the amount of energy necessary for transfer is generally evenly determined by the configuration of the transfer portion and the material properties of the ink, so raising the upper limit of the resistance value increases the necessary voltage, and is restricted by the rated voltage of the driver IC and the power source voltage. Or, lowering the lower limit of the resistance value increases the necessary voltage, and is restricted by the rated voltage of the driver IC and the power source voltage. Also, in the event that the resistance value is small, the ratio with the wiring resistance is no longer negligible, and the drop in voltage at the wiring portion may show up as irregularities in printing concentration, due to a so-called common drop. Also, irregularities in the resistance values of the heaters shows up in the ratio to the resistance values.

Accordingly, as described above, in the event that there are none of the above restrictions, it is preferable that the resistance value of the "high-resistance portion" be within a range of around 100 Ω to 20 KΩ, and taking into consideration the rated voltage (e.g., 36 V) of the driver IC to be actually used and the resistance value irregularities, the sheet resistance value should preferably be designed to be from around 1 KΩ to 5 KΩ.

Also, regarding the "low-resistance portion", the resistance value should be set between ⅕ to 1/20 of that of the "high-resistance portion", from a perspective of keeping the above-described energy losses minimal. It is thought that there is a limit to how low the lower limit can be taken, due to restrictions in the manufacturing process, since the amount of doping impurities for ion injection would have to be increased by a degree of an entirely different order.

In other words, it is preferable that the ratio in resistance value between the low-resistance portion and the high-resistance portion be ⅕ or greater (preferably 1/20 or less), and it is preferable that the resistance value of the high-resistance portion be 100 Ω to 20 KΩ (preferably 1 KΩ to 5 KΩ).

The following is a detailed description of an embodiment of the present invention. However, it should be noted that the present invention is by no means restricted to this embodiment.

With the present embodiment, a printer head having the transfer portion structures such as shown in FIGS. 1 through 3 was manufactured, following the embodiment of the first recording apparatus according to the present invention described above.

<Manufacturing the Printer Head>

First, the procedures for manufacturing the printer head 100 according to the present embodiment will be described with reference to the FIGS. 11 through 19.

Figure 11:
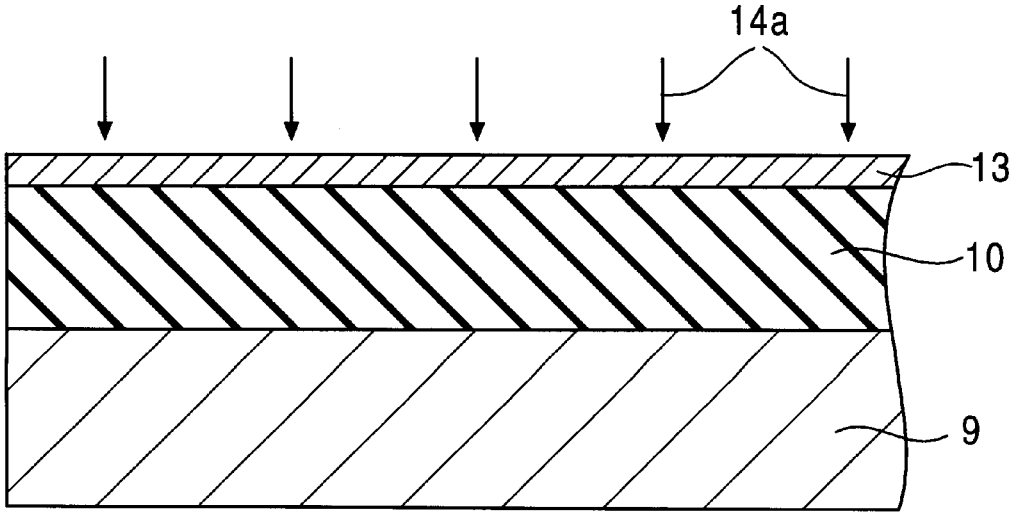
FIG. 11 is a schematic cross-sectional diagram illustrating one process step for manufacturing a printer head based on an embodiment according to the present invention.

As shown in FIG. 11, a thermal oxidization film ($SiO_2$ film) was formed on a silicone substrate 9 by thermal oxidization to a thickness of 3 μm to serve as a thermal insulating layer 10, and a poly-silicone layer 13 was formed on this thermal oxidization film (thermal insulating layer) 10 by reduced-pressure CVD to a thickness of approximately 400 nm. Next, in order to form a high-resistance portion 2A and low-resistance portion 3A within the poly-silicone layer 13, first, $2\times10^{14}/cm^2$ of $B^+$ (boron) serving as the impurity ion 14*a* was injected to the entire surface at 60 KeV.

Figure 12:
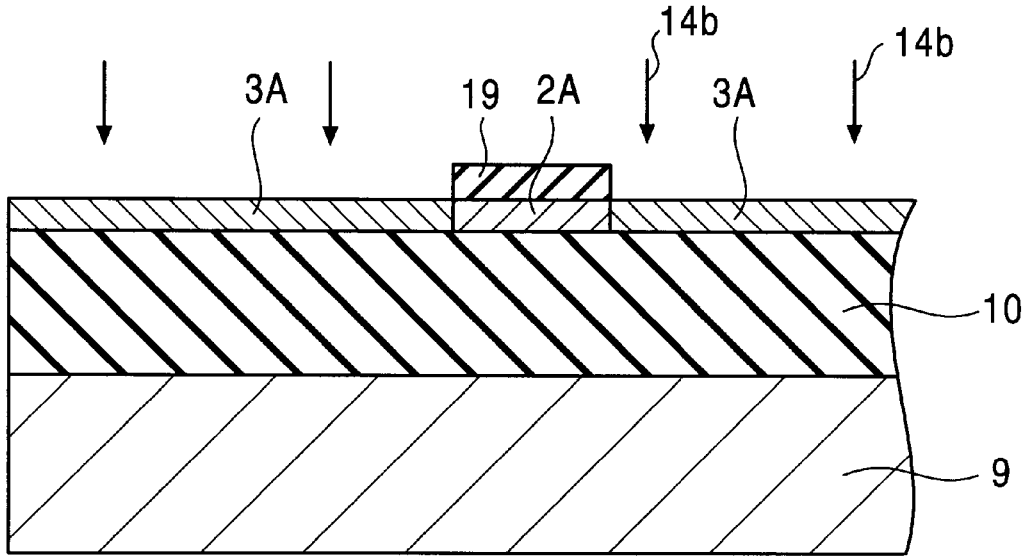
FIG. 12 is a schematic cross-sectional diagram illustrating another process step for manufacturing the printer head according to the same.

Next, as shown in FIG. 12, a mask 19 (resist) with a certain pattern was formed so as to cover the 20 μm by 20 μm high-resistance portion 2A to serve as a heater portion, following which the dose was changed and $5\times10^{15}/cm^2$ of $B^+$ (boron) serving as the impurity 14*b* was injected only to the area to become the low-resistance portion 3A at 60 KeV. The resist 19 may be left on the structure, but here is was removed.

Next, a $SiO_2$ film was formed by CVD to a thickness of 300 nm on the poly-silicone layer of which the high-resistance portion 2A and low-resistance portion 3A had been formed, following which annealing was performed for 30 minutes at 1,000° C., resulting in the resistance values of the high-resistance portion 2 and the low-resistance portion 3 being 3.5 KΩ and 200 Ω, respectively.

Figure 13:
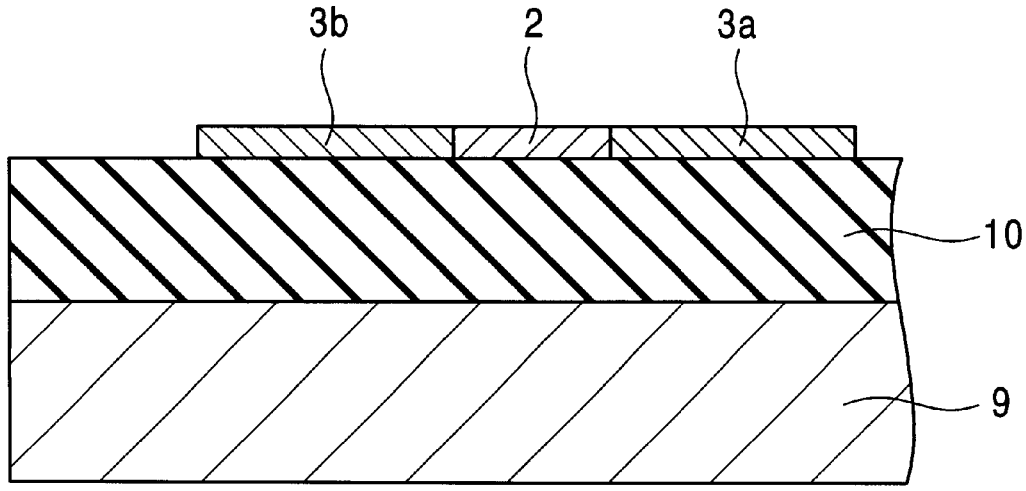
FIG. 13 is a schematic cross-sectional diagram illustrating another process step for manufacturing the printer head according to the same.

Then, following removal of the $SiO_2$ film on the poly-silicone, a mask of a certain pattern (omitted in the Figure) was formed, and the high-resistance portion 2 and the low-resistance portions 3*a* and 3*b* were formed in a certain pattern by RIE, as shown in FIG. 13.

Figure 14:
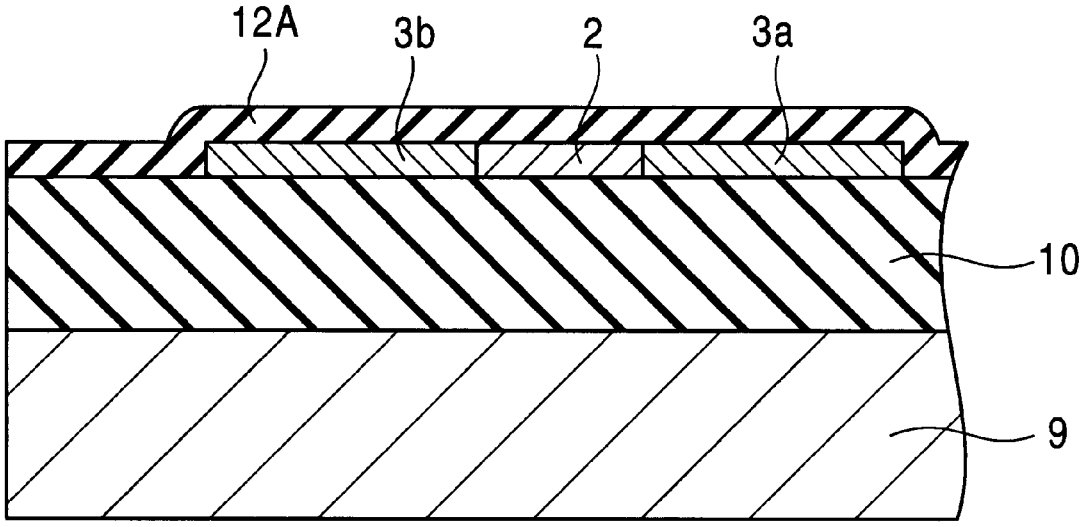
FIG. 14 is a schematic cross-sectional diagram illustrating another process step for manufacturing the printer head according to the same.

Next, as shown in FIG. 14, an $SiO_2$ film 12A to serve as a protective layer 12 was formed over the entire surface of the high-resistance portion 2 and the low-resistance portions 3*a* and 3*b* by CVD to a thickness of 900 nm, and then flattened by etching back.

Figure 15:
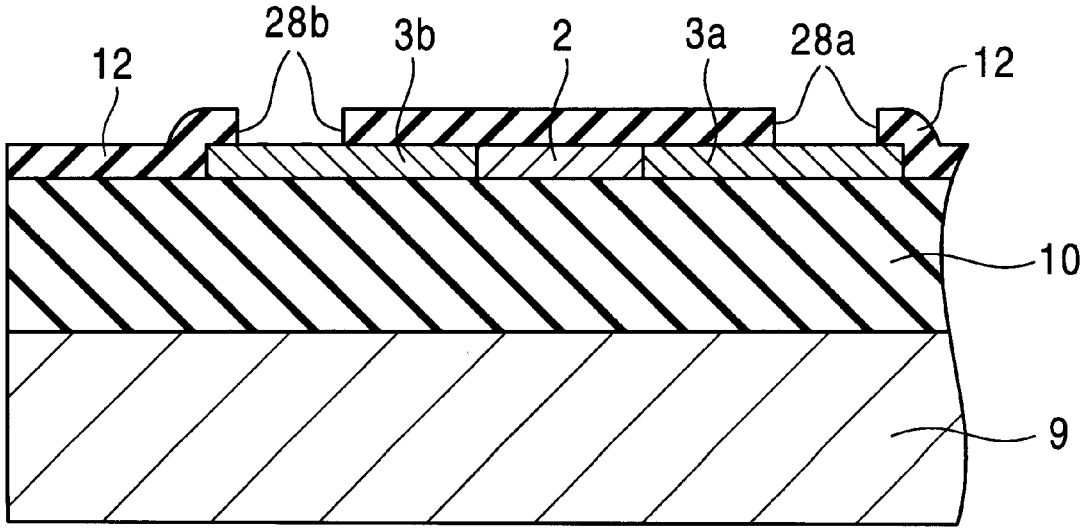
FIG. 15 is a schematic cross-sectional diagram illustrating another process step for manufacturing the printer head according to the same.

Next, as shown in FIG. 15, following forming a mask (not shown in the Figure) of a certain pattern, connecting holes (openings) 28*a* and 28*b* were formed in the $SiO_2$ film 12*a* so as to encounter the low-resistance portions 3*a* and 3*b* on either side of the high-resistance portion 2.

Figure 16:
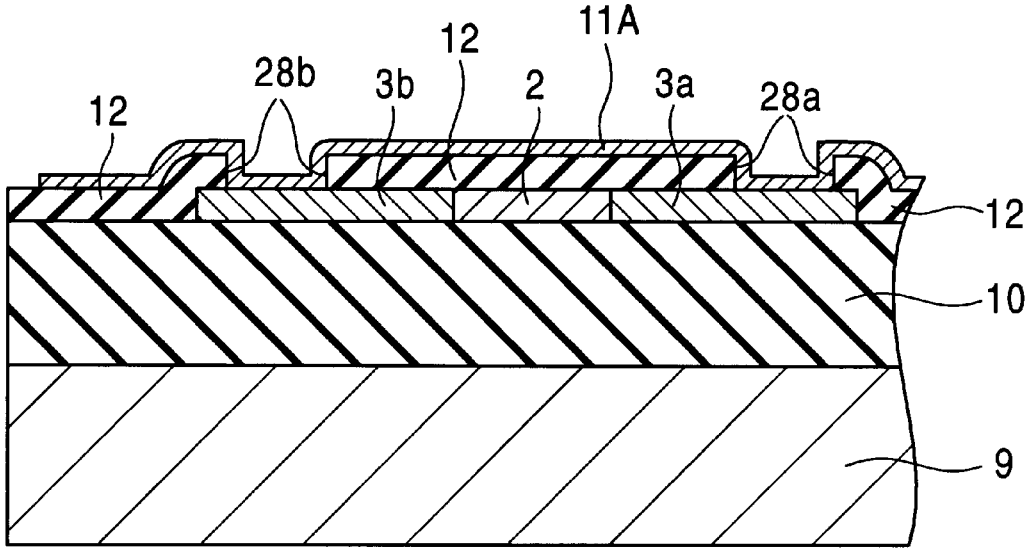
FIG. 16 is a schematic cross-sectional diagram illustrating another process step for manufacturing the printer head according to the same.

Next, as shown in FIG. 16, a barrier metal layer was formed by sequentially layering Ti, TiON, and Ti in respective thicknesses of 30 nm, 50 nm, and 70 nm by the sputtering method, thus forming a barrier metal layer 11A of a layered structure of Ti/TiON/Ti. Incidentally, the TiON was formed by Ti reactive sputtering in an atmosphere of oxygen gas and nitrogen gas.

Figure 17:
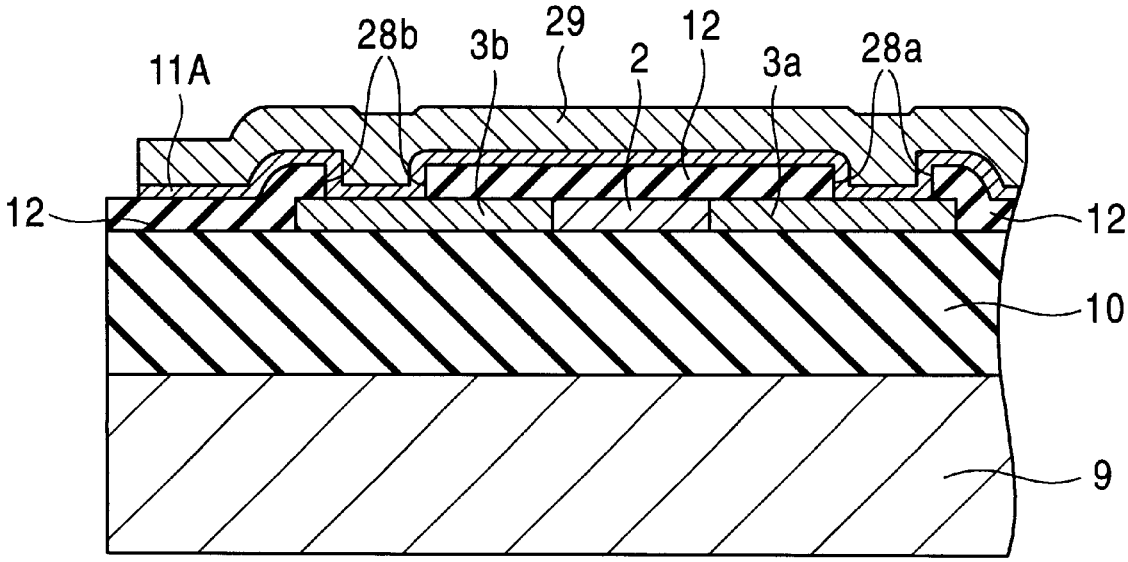
FIG. 17 is a schematic cross-sectional diagram illustrating another process step for manufacturing the printer head according to the same.
Figure 18:
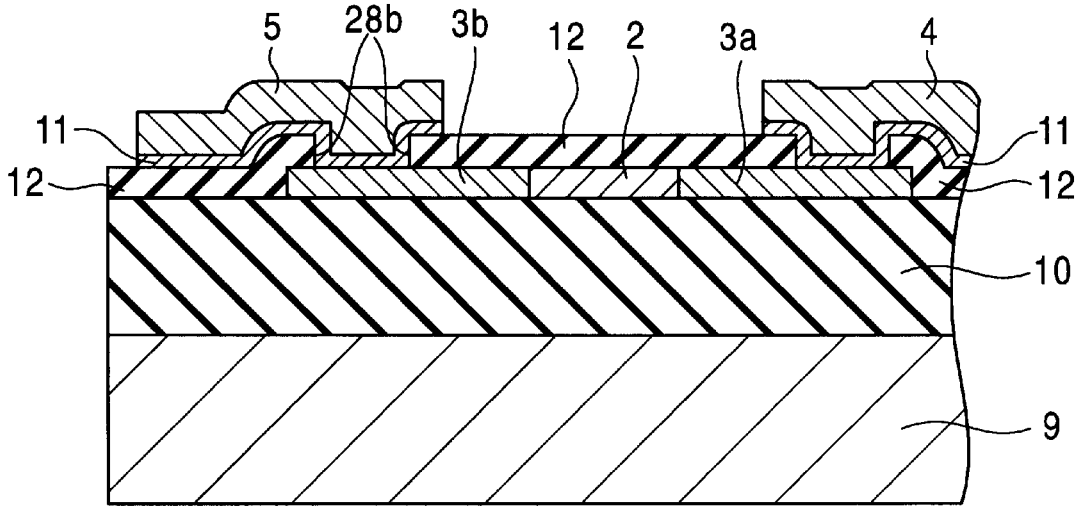
FIG. 18 is a schematic cross-sectional diagram illustrating another process step for manufacturing the printer head according to the same.

Next, as shown in FIG. 17, an Al—Si layer 29 to serve as the electrodes 4 and 5 is formed over the entire surface of the barrier metal layer 11A by sputtering to a thickness of 6+00 nm, following which, as shown in FIG. 18, a mask of a certain pattern was formed in order to form the electrodes in the certain pattern, thus forming the individual electrode 4 and common electrode 5 to conduct electricity to the low-resistance portions 3*a* and 3*b* provided next to either side of the high-resistance portion 2, with the barrier metal layer 11 positioned between the individual electrode 4 and common electrode 5 and the low-resistance portions 3*a* and 3*b*.

Figure 19:
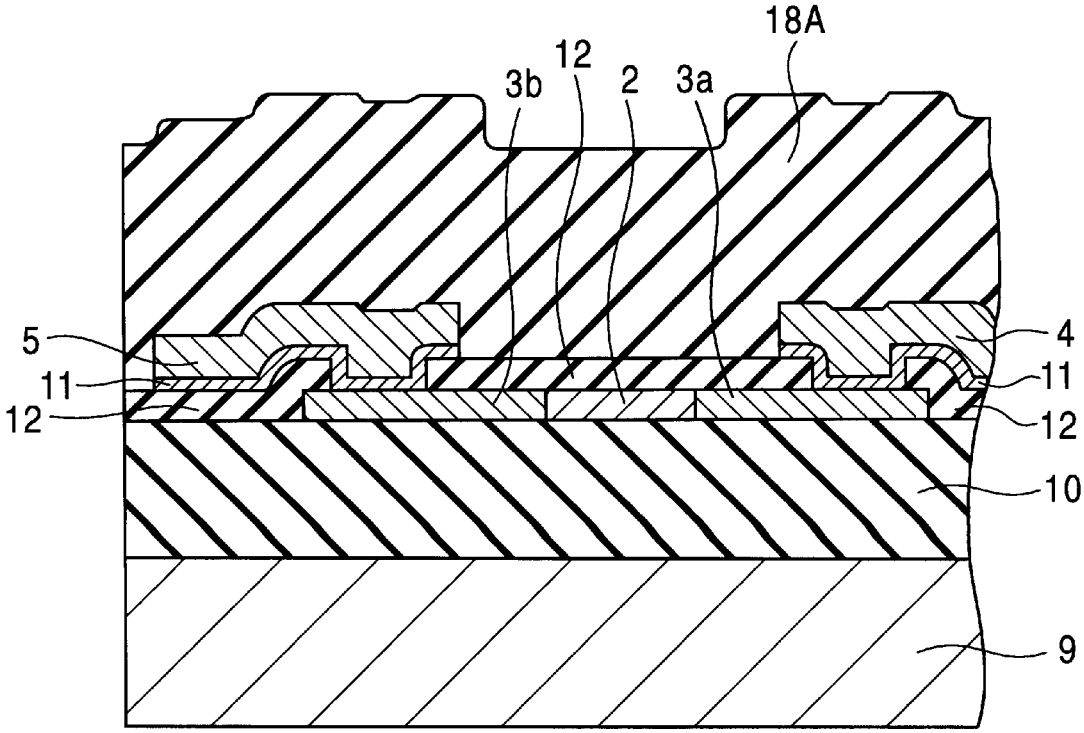
FIG. 19 is a schematic cross-sectional diagram illustrating another process step for manufacturing the printer head according to the same.

Next, as shown in FIG. 19, an $SiO_2$ layer 18A was formed by CVD to a thickness of 6 μm. Subsequently, though omitted in the drawings, an electrode extracting portion for connecting to the driver IC was etched to a depth of 1.5 μm by RIE, following which a mask of a certain pattern for the post-like members, partitions, etc., was formed, and etching was performed by RIE to a depth of approximately 5 μm. Further, annealing was performed at 400° C. for 30 minutes, sintering processing was performed so as to realize Ohmic contact between the low-resistance portions 3 and the electrodes 4 and 5, thereby forming a transfer portion structure having the structure such as shown in FIG. 2.

The rectangular post-like members 6 were formed so that each had a form of 3 μm by 3 μm and a height of 5 μm, these being arrayed in a 9 by 9 square matrix on the transfer portion 1 with the post-like members spaced with 6 μm between the centers of neighboring post-like members. Nine post-like members 6 were arrayed on the high-resistance portion 2 serving as the heater. Also, as shown in FIG. 3, the neighboring transfer portions 1 were of a height of 5 μm which is the same as the post-like members 6 and were separated by partitions 7 of 25 μm in width, with a supplying channel 15 being provided for each transfer portion 1. Further, accessory walls 8 approximately 5 μm in height and approximately 10 μm in width were provided around the center of each of the supplying channels 15. Moreover, the ink holding structure in the transfer portion 1 formed of the post-like members 6 was extended to the portion between the pair of partitions 7 defining the supplying channel 15 and the accessory wall 8.

Also, 256 of the above transfer portion structures were arrayed at 85 μm cycles, thereby forming one printer head (heater chip).

<Measuring the Resistance Values of the 256 Resistance Heating Means>

Figure 20:
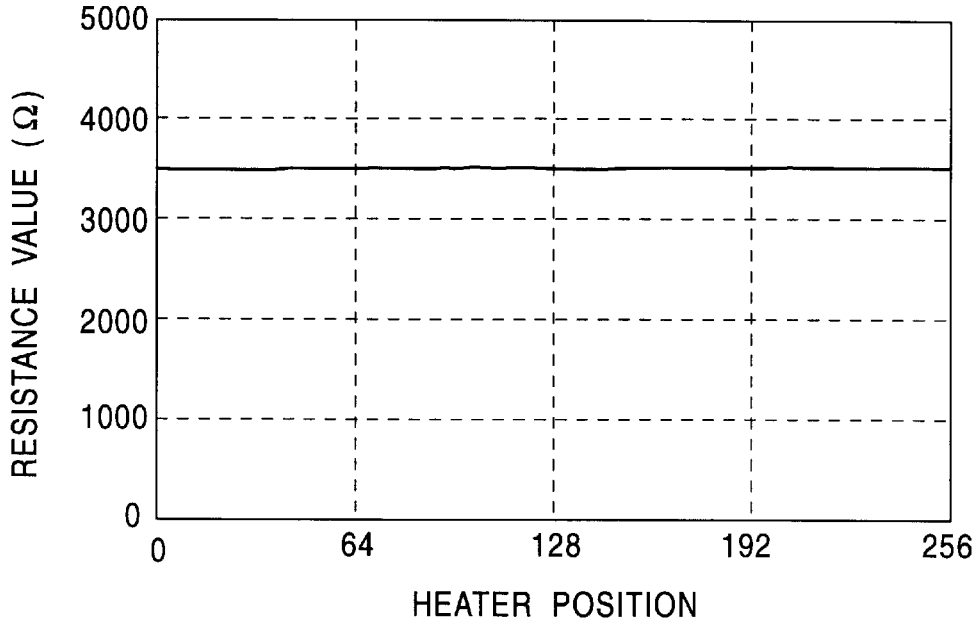
FIG. 20 is a graph illustrating the resistance values of the 256 heaters in the printer head based on an embodiment according to the present invention.

FIG. 20 shows the measurement results of the resistance values of the 256 continuous high-resistance portions (heaters) in this single printer head (embodiment). As can be understood from FIG. 20, the neighboring resistance value difference was kept within 0.5% at all heater positions, indicating that the resistance values are extremely uniform. That is, the resistance values of each of the heaters in the multiple transfer portions are even, the amount of heat from Joule heat does not generate deviations for the same image information, meaning that irregularities in concentration within the transferred image do not occur and a high-quality image is obtained.

Figure 22:
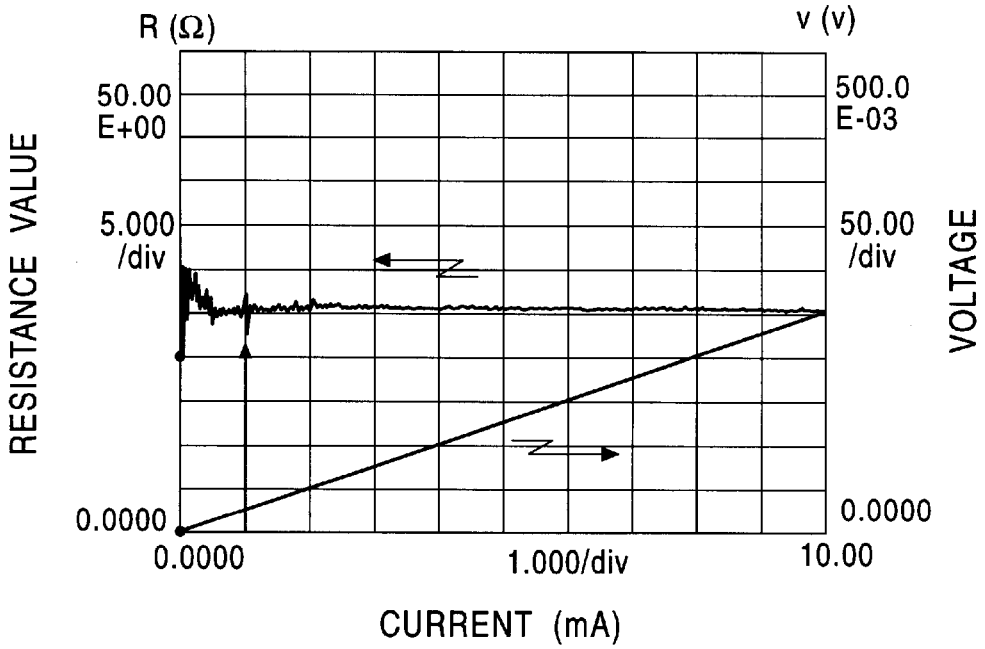
FIG. 22 is a graph illustrating the resistance value-current properties and voltage-resistance value properties of the heaters of a printer head based on an embodiment according to the present invention.

Also, it can be understood that, in the event the transfer portion based on the present embodiment is formed, the resistance value-current (R-I) properties and voltage-resistance value-current (V-I) properties at the point of connection between the poly-silicone (high-resistance portion) and the Al electrodes (individual electrode and common electrode) exhibit an almost straight line as shown in FIG. 22, indicating that Ohmic contact has been realized. However, is should be noted that the measurements were made with a connection portion pattern for measurement, with poly-silicone/barrier metal/aluminum being connected (i.e., the value for one heater).

Figure 25A:
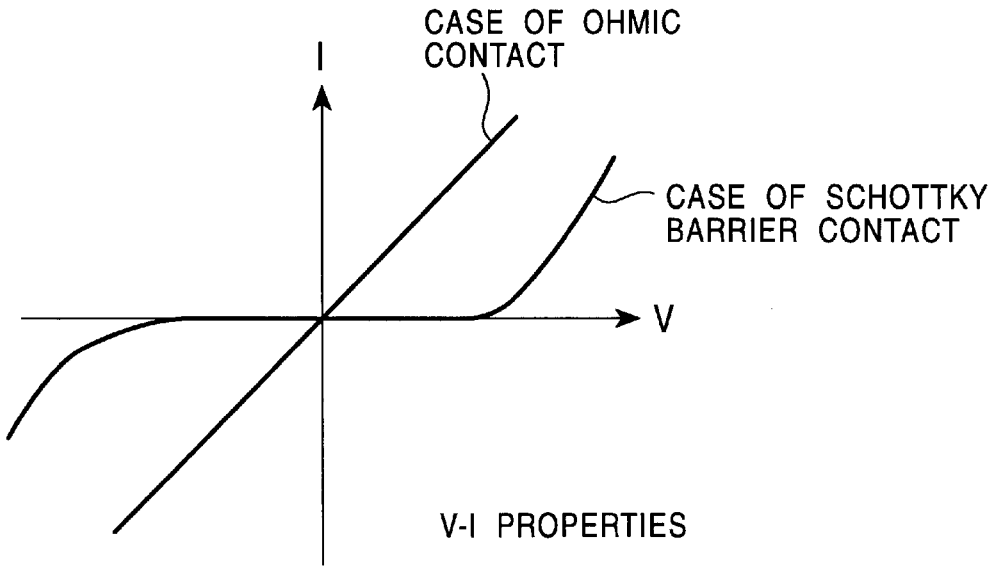
FIG. 25A is a voltage-current properties graph showing the respective cases of Ohmic contact and Schottky barrier.
Figure 25B:
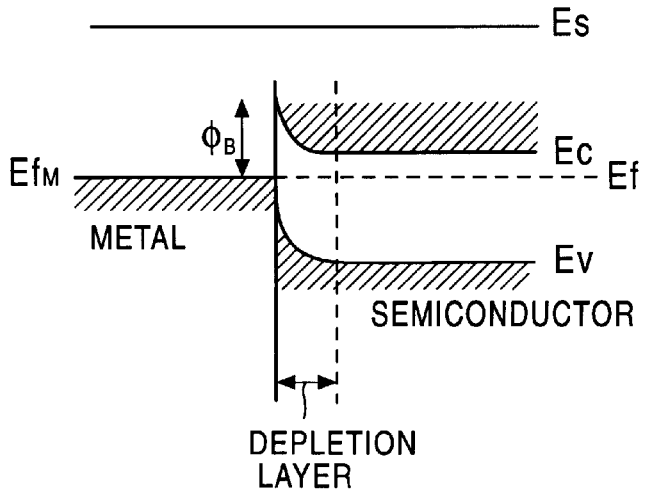
FIG. 25B is a diagram showing the energy band at the junction between metal and semiconductor.
Figure 26:
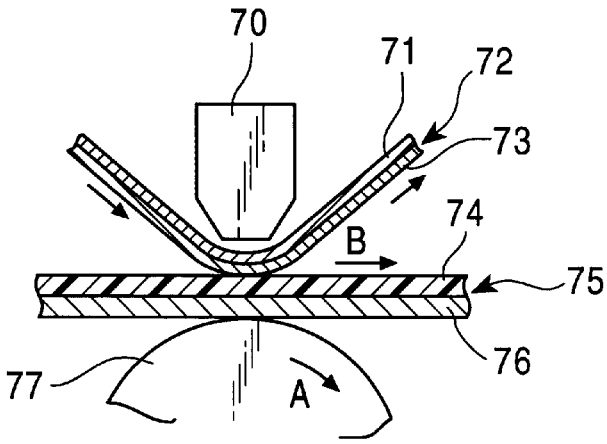
FIG. 26 is a schematic model diagram illustrating the configuration of a known sublimation-type thermal transfer printer.

Also, generally, in the case of Ohmic contact, the voltage and current are in a proportional relation, as shown in FIG. 25A. In order to realize Ohmic contact between semiconductor material and metal, the following serve as an effective means, as shown in FIG. 25B:

(1) reducing the Schottky barrier height $\phi_B$ which is the difference between the Fermi level of the metal (EfM) and the conduction band of the semiconductor material (Ec), and (2) narrowing the width of the depletion layer.

That is to say, as with the present embodiment, doping the poly-silicone which is the low-resistance portion material with $B^+$ (boron) lowers the $\phi_B$ of the aluminum which is the electrode material, and further, the depletion layer of this poly-silicone low-resistance portion can be narrowed in comparison with the high-resistance portion, thus sufficiently realizing Ohmic contact by connecting the low-resistance portion and aluminum electrodes.

Figure 27:
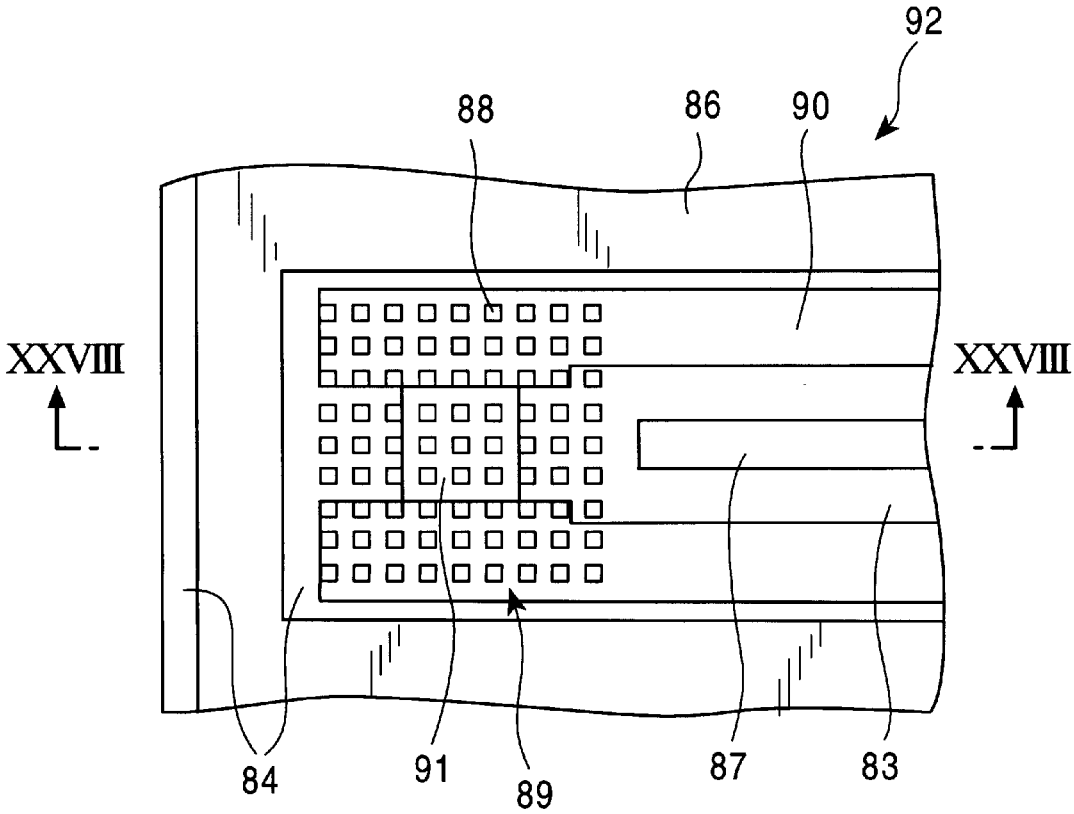
FIG. 27 is a schematic enlarged plan view of the transfer portion area of a printer head based on the known dye-vaporization type thermal transfer method.

In comparison with this, a printer head having a transfer portion structure such as shown in FIG. 27 and FIG. 28 was manufactured.

Figure 24:
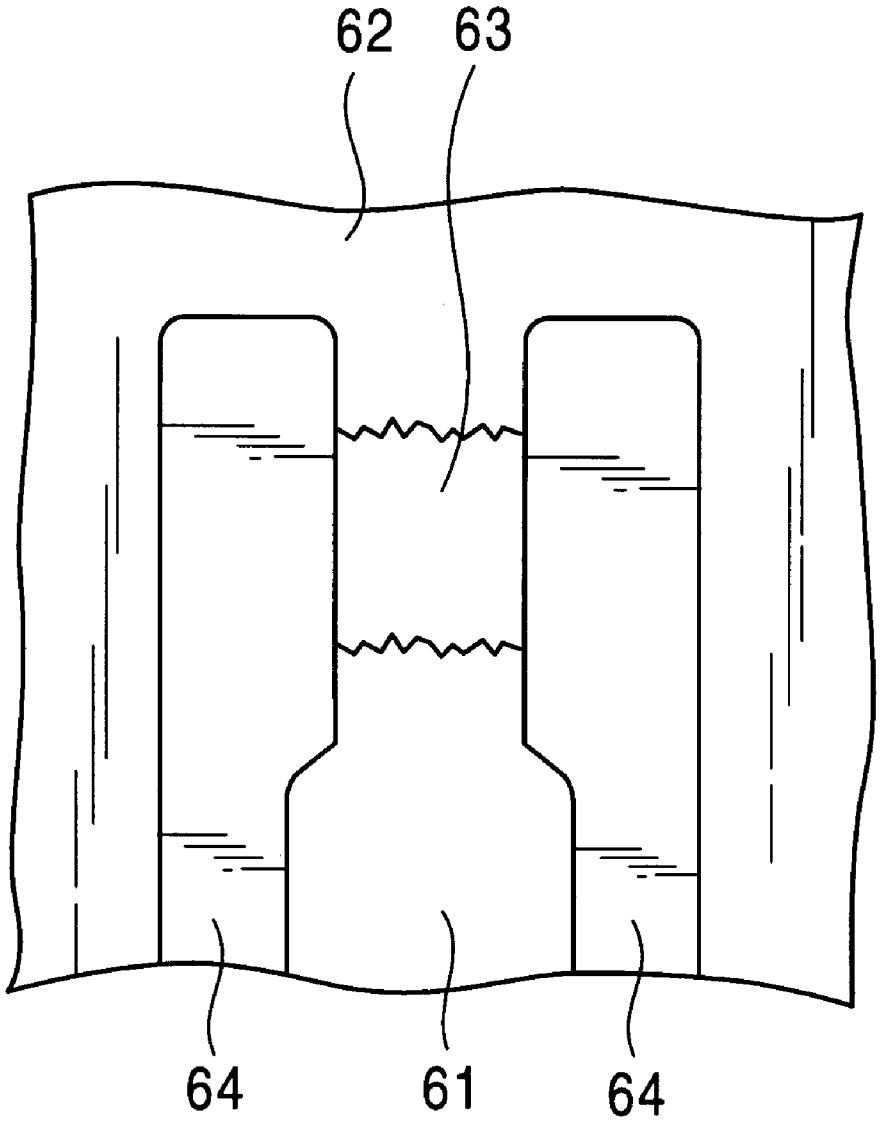
FIG. 24 is a schematic model diagram illustrating the state of dispersion of aluminum to poly-silicone.

As shown in FIG. 24 as a model diagram, confirmation was made that aluminum 62 which is the principal component of the common electrode and aluminum 61 which is the principal component of the individual electrode had dispersed into the poly-silicone 63 comprising the resistance heating portion. This diagram illustrates the state of thermal dispersion of aluminum in the thermal processing during manufacturing (i.e., in the sintering process).

Figure 21:
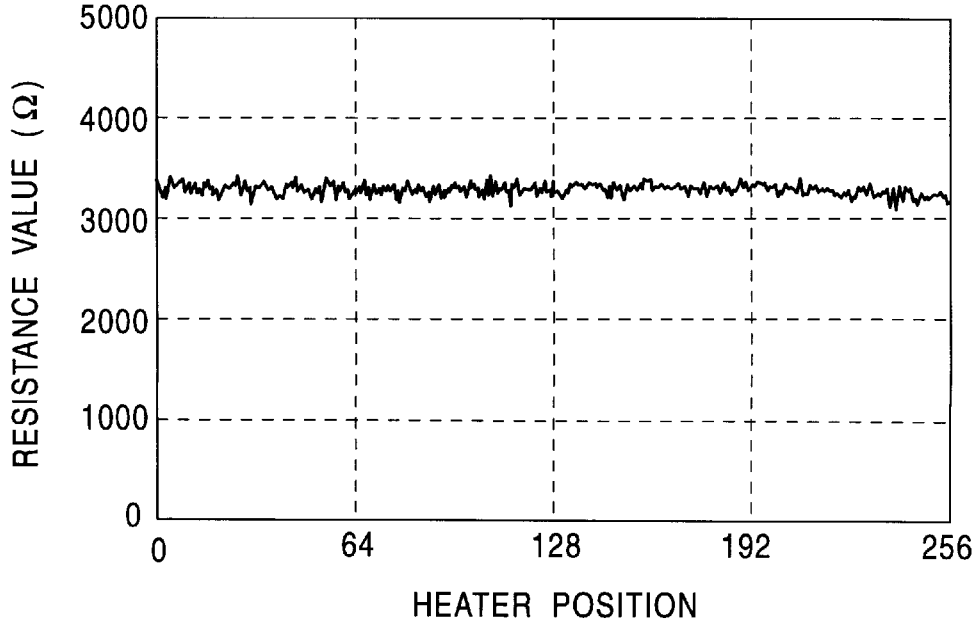
FIG. 21 is a graph illustrating the resistance values of the 256 heaters in a known printer head.

Also, using a printer head with 256 such continuous transfer portion structures, the resistance values of the 256 continuous resistance heating portions was measured. FIG. 21 shows the measurement results (comparative example). According to FIG. 21, dispersion of the aluminum (electrode material) to the poly-silicone (heater material) has caused the resistance values of the heater portions to vary greatly, so the neighboring resistance value difference is around 6%. Accordingly, transferring ink to the recording medium in this state causes irregularities in concentration, thus causing deterioration of image quality.

Figure 23:
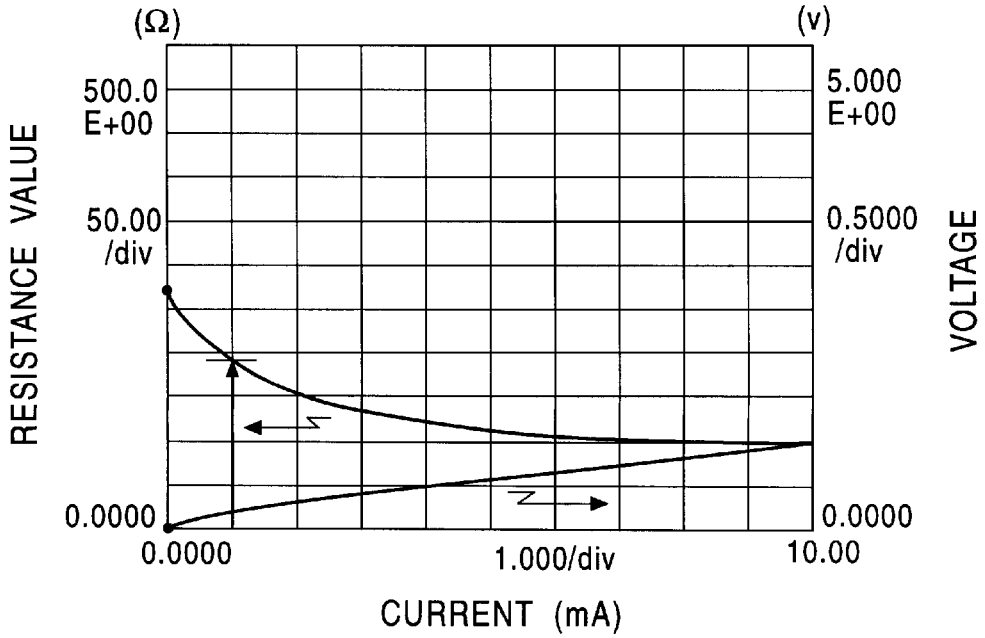
FIG. 23 is a graph illustrating the resistance value-current properties and voltage-resistance value properties of the heaters of a known printer head.

Further, in the event that the transfer portion is formed of a structure such as shown in FIG. 27 and FIG. 28, the voltage-resistance value (V-I) properties between the poly-silicone and the Al electrode connection form a curve such as shown in FIG. 23, meaning that Ohmic contact is not being realized. This is due to the high-resistance semiconductor (poly-silicone) coming into direct contact with the metal (Al), thus raising the Schottky barrier height $\phi_B$.

As described above, according to the present embodiment, the electrodes such as the individual electrode and common electrode for conducting electricity to the high-resistance portion serving as the heating element (heater) are directly connected to low-resistance portions provided in contact with the high-resistance portion, and the high-resistance portion and electrodes are not in direct contact, so dispersion of the aluminum to the poly-silicone owing to heat processing in the process for forming the electrodes, or owing to own heat generated at the time of driving the printer head, can be prevented. Accordingly, irregularities in the resistance values of the resistance heating means provided to the multiple transfer portions can be suppressed, thus yielding high-quality images without irregularities.

Further, there is Ohmic contact between the heater and electrode material, so linear properties can be obtained when using voltage modulation instead of pulse amplitude modulation for driving the heater, thereby facilitating ease of control of the amount of heat generated.

Thus, with the first recording apparatus according to the present invention, a recording apparatus is configured of a transfer portion for holding recording material such as ink and a resistance heating means for heating the recording material such that the recording material is caused to fly, thereby transferring onto a recording medium such as photographic printing paper disposed opposing the transfer portion, as with the above-described dye-vaporizing thermal transfer method for example;

wherein the resistance heating means is comprised of a high-resistance portion provided adjacent to a low-resistance portion; and wherein electrodes such as individual electrodes and common electrodes for conducting to the high-resistance portion are connected to the low-resistance portion, and the high-resistance portion and electrodes are not in direct contact;

so dispersion of the material comprising the electrodes to the material comprising the high-resistance portion, for example, owing to heat processing in the manufacturing processes such as the electrode formation step, or owing to own heat generated from the resistance heating means at the time of driving the recording apparatus, can be prevented, thereby suppressing irregularities in the resistance values of the resistance heating means due to this dispersion and the like. That is to say, the resistance value of each of the resistance heating means can be maintained at a desired, both at the process of manufacturing and over time, thereby suppressing irregularities in the resistance values of the individual resistance heating means of the multiple transfer portions, there is no deviation regarding the same image information, concentration irregularities in the transferred image are suppressed, and an image that has high quality and is true to the image information can be obtained.

Also, with the method for manufacturing the first recording apparatus according to the present invention, the first recording apparatus according to the present invention can be manufactured with good reproducibility.

With the second recording apparatus according to the present invention, a recording apparatus is configured of a transfer portion for holding recording material and a resistance heating means for heating the recording material such that the recording material is caused to fly, thereby transferring onto a recording medium disposed opposing the transfer portion, as with the above-described dye-vaporizing thermal transfer method for example;

wherein a barrier metal layer formed of material with a high melting point is disposed between the resistance heating means and the electrodes such as the individual electrodes and common electrodes for conducting to the resistance heating means;

so dispersion of the material comprising the electrodes to the material comprising the high-resistance portion, for example, owing to heat processing in the manufacturing processes for forming the resistance heating means and electrodes, or owing to own heat generated from the resistance heating means at the time of driving the recording apparatus, can be prevented. Accordingly, irregularities in the resistance values of the resistance heating means due to this dispersion and the like can be suppressed, consequently yielding images with high quality.

What is claimed is:

1. A recording apparatus, comprising:

a transfer portion for holding recording material;

a resistance heating means for heating said recording material such that said recording material is caused to fly, said resistance heating means comprising:

a low-resistance portion; and a high-resistance portion adjacent to said low-resistance portion;

a recording medium disposed opposing said transfer portion, whereby said recording material caused to fly is transferred onto said recording medium; and electrodes connected to said low-resistance portion for conducting electricity through said low-resistance portion to said high-resistance portion.

2. A recording apparatus according to claim 1, wherein two low-resistance portions are provided adjacent to two sides of said high-resistance portion, and said electrodes are connected to said two low-resistance portions.

3. A recording apparatus according to claim 2, wherein said high-resistance portion and said two low-resistance portions are of approximately the same height.

4. A recording apparatus according to claim 1, further comprising a semiconductor material layer, said semiconductor material layer having neighboring portions, said neighboring portions doped with different concentrations of impurities to form said high-resistance portion and said low-resistance portion.

5. A recording apparatus according to claim 1, wherein a barrier metal layer is formed between said low-resistance portion and said electrodes.

6. A recording apparatus according to claim 4, wherein a protective layer is formed over said high-resistance portion and low-resistance portions, with electrode connection holes being formed in said protective layer.

7. A recording apparatus according to claim 1, wherein, in said resistance heating means, said transfer portion has a recording material holding structure for holding said recording material by capillary phenomena.

8. A recording apparatus according to claim 7, wherein said recording material holding structure has a plurality of minute gaps, said recording material being held in said minute gaps by capillary phenomena.

9. A recording apparatus according to claim 7, wherein the upper face of said recording material holding structure is a flat plane.

10. A recording apparatus according to claim 1, wherein said resistance heating means is formed of poly-silicone, and said electrodes are formed primarily of aluminum.

11. A method for manufacturing a recording apparatus configured of a transfer portion for holding recording material and a resistance heating means for heating said recording material such that said recording material is caused to fly, thereby transferring onto a recording medium disposed opposing said transfer portion, said method comprising;

creating a high-resistance portion provided adjacent to a low-resistance portion, to serve as said resistance heating means; and forming electrodes on said low-resistance portion for conducting electricity through said low-resistance portion to said high-resistance portion.

12. A method for manufacturing a recording apparatus according to claim 11, wherein two low-resistance portions are provided adjacent to two sides of said high-resistance portion, and said electrodes are connected to said two low-resistance portions.

13. A method for manufacturing a recording apparatus according to claim 12, wherein said high-resistance portion and said low-resistance portions are formed at approximately the same height.

14. A method for manufacturing a recording apparatus according to claim 11, further comprising forming a semiconductor material layer on a substrate, said semiconductor layer having neighboring portions, said neighboring portions doped with different concentrations of impurities to form said high-resistance portion and said low-resistance portion.

15. A method for manufacturing a recording apparatus according to claim 11, wherein a barrier metal layer is formed between said low-resistance portion and said electrodes.

16. A method for manufacturing a recording apparatus according to claim 14, wherein a protective layer is formed over said high-resistance portion and low-resistance portions, annealing is performed following said doping with impurities, and subsequently forming electrode connection holes in said protective layer.

17. A method for manufacturing a recording apparatus according to claim 11, wherein, in said resistance heating means, a recording material holding structure for holding said recording material by capillary phenomena is formed in said transfer portion.

18. A method for manufacturing a recording apparatus according to claim 17, wherein a plurality of minute gaps are formed in said recording material holding structure, for holding said recording material by capillary phenomena.

19. A method for manufacturing a recording apparatus according to claim 17, wherein the upper face of said recording material holding structure is formed into a flat plane.

20. A method for manufacturing a recording apparatus according to claim 11, wherein said resistance heating means is formed of poly-silicone, and said electrodes are formed primarily of aluminum.

21. A recording apparatus, comprising:

a transfer portion for holding recording material;

a resistance heating means for heating said recording material such that said recording material is caused to fly, thereby transferring onto a recording medium disposed opposing said transfer portion; and electrodes for conducting electricity to said resistance heating means, wherein a barrier metal layer is disposed between said resistance heating means and said electrodes.

22. A recording apparatus according to claim 21, wherein, in said resistance heating means, said transfer portion has a recording material holding structure for holding said recording material by capillary phenomena.

23. A recording apparatus according to claim 22, wherein said recording material holding structure has a plurality of minute gaps, said recording material being held in said minute gaps by capillary phenomena.

24. A recording apparatus according to claim 21, wherein said resistance heating means is formed of poly-silicone, and said electrodes are formed primarily of aluminum.

* * * * *